US010767379B1

(12) United States Patent
McLeod et al.

(10) Patent No.: US 10,767,379 B1
(45) Date of Patent: Sep. 8, 2020

(54) METHOD OF SEATING A FLOOR PANEL

(71) Applicant: ACSM, Inc., Phoenix, AZ (US)

(72) Inventors: Bret Robert McLeod, Scotts Valley, CA (US); Patrick Merrick Judson, Brentwood, CA (US)

(73) Assignee: ACSM, Inc., Phoenix, AZ (US)

( * ) Notice: Subject to any disclaimer, the term of this patent is extended or adjusted under 35 U.S.C. 154(b) by 0 days.

(21) Appl. No.: 16/707,418

(22) Filed: Dec. 9, 2019

Related U.S. Application Data

(60) Provisional application No. 62/937,672, filed on Nov. 19, 2019, provisional application No. 62/885,479, filed on Aug. 12, 2019.

(51) Int. Cl.
*E04B 1/00* (2006.01)
*E04G 21/18* (2006.01)
*E04B 1/35* (2006.01)

(52) U.S. Cl.
CPC ..... *E04G 21/1841* (2013.01); *E04B 1/35* (2013.01); *E04B 2001/3572* (2013.01)

(58) Field of Classification Search
None
See application file for complete search history.

(56) References Cited

U.S. PATENT DOCUMENTS 2,416,371 A 2/1947 Bockius
3,256,030 A * 6/1966 Banse ..... E04B 1/2608 403/400
3,667,786 A * 6/1972 Cooper ..... E04B 1/2608 403/384
4,124,962 A 11/1978 Lancelot, III et al.
6,295,781 B1 * 10/2001 Thompson ..... E04B 1/2608 403/232.1
6,301,855 B1 10/2001 Aerni
6,513,286 B2 2/2003 Vierra
6,817,157 B2 11/2004 Bourque
7,316,098 B1 * 1/2008 Sackett ..... E04B 7/045 52/712
7,805,894 B2 10/2010 Contasti
9,151,058 B1 10/2015 Leathe
9,249,574 B2 2/2016 Mei
9,932,735 B1 4/2018 Biasucci et al.
10,202,766 B1 * 2/2019 Fox ..... E04B 1/2604
10,358,811 B1 * 7/2019 Fox ..... E04B 7/045
(Continued)

FOREIGN PATENT DOCUMENTS

CA 2 911 115 5/2016

*Primary Examiner* — Gisele D Ford
(74) *Attorney, Agent, or Firm* — Knobbe, Martens, Olson & Bear, LLP

(57) ABSTRACT

Disclosed herein are embodiments of a floor panel seating assembly. The floor panel seating assembly can include adjustable, removable brackets or guides for guiding cross-members and joists of floor panels into their desired positions on a support structure. Also disclosed herein are embodiments of a method of seating a floor panel. The method can include providing one or more adjustable, removable bracket or guide, adjusting the guide(s) to accommodate the width of a wall of the support structure and/or the sizes of the cross-members or joists of the floor panel, mounting the guide(s) to the support structure, and lowering a floor panel into position on the support structure using the guide(s).

17 Claims, 32 Drawing Sheets

(56) References Cited

U.S. PATENT DOCUMENTS

| | | | | |
|---|---|---|---|---|
| 2006/0150564 | A1* | 7/2006 | Dufault | E04B 7/045 52/702 |
| 2007/0193195 | A1 | 8/2007 | Smith | |
| 2008/0244993 | A1* | 10/2008 | Crumley | E04B 7/045 52/92.2 |
| 2008/0282641 | A1* | 11/2008 | Sackett | E04B 7/045 52/715 |
| 2008/0283702 | A1 | 11/2008 | Ikerd | |
| 2009/0025308 | A1 | 1/2009 | Deans et al. | |
| 2009/0113839 | A1* | 5/2009 | Carr | E04B 1/2612 52/712 |
| 2009/0178362 | A1* | 7/2009 | Jerke | E04H 9/14 52/656.9 |
| 2015/0218832 | A1* | 8/2015 | Peters | E04B 5/12 269/46 |
| 2016/0177560 | A1* | 6/2016 | Hensen | E04B 1/2608 52/272 |
| 2019/0271147 | A1* | 9/2019 | Hensen | E04B 1/2608 |
| 2019/0285224 | A1* | 9/2019 | McKechnie | E04B 9/183 |

* cited by examiner

METHOD OF SEATING A FLOOR PANEL

The present application claims the benefit of U.S. Patent Application No. 62/885,479, filed Aug. 12, 2019, and U.S. Patent Application No. 62/937,672, filed Nov. 19, 2019, each of which is hereby incorporated by reference in its entirety herein.

INCORPORATION BY REFERENCE

Any and all applications for which a foreign or domestic priority claim is identified in the Application Data Sheet as filed with the present application are hereby incorporated by reference under 37 CFR 1.57.

BACKGROUND

Field

The present disclosure is generally related to floor seating methods and assemblies useful in practicing the method.

Description of the Related Art

Brackets are configured for supporting structural members, such as joists, in buildings. Some such brackets include guide surfaces.

SUMMARY

Disclosed herein are embodiments of a bracket for seating a floor panel during construction of a building, the bracket comprising a vertical segment defining a first outer surface, an angled segment defining a second outer surface, wherein the bracket is configured to attach to a wall, the bracket being adjustable to accommodate different wall plate, floor rim, or floor joist sizes, and wherein the bracket is configured to guide a floor panel along the outer surfaces of the bracket from the second outer surface of the angled segment towards the first outer surface of the vertical segment.

Also disclosed herein are embodiments of a method of using a bracket to guide a floor panel during construction of a building, the method comprising providing an assembled floor panel, locating a desired floor panel position on a support structure for a floor panel, and mounting a first bracket in a desired bracket position to the support structure.

In some embodiments, the method can further comprise mounting another bracket in another desired bracket position on a second end of the support structure.

In some embodiments, the method can further comprise mounting the first bracket along a first end of the panel and mounting another bracket along a side of the support structure adjoining the first end of the panel.

Also disclosed herein are embodiments of a method of using a bracket to guide a floor panel during construction of a building, the method comprising providing a removable bracket, adjusting the bracket to accommodate a joist, wall, or rim, mounting the bracket in position, and lowering an assembled floor panel such that an outer perimeter of the floor panel aligns with an inner surface of the bracket.

Also disclosed herein are embodiments of a method of positioning at least one floor panel during construction of a building, the method comprising providing a first assembled floor panel including a plurality of joists extending between a first pair of sides and a pair of cross-members extending between a second pair of sides, locating a desired first floor panel position on a support structure for a floor panel, said support structure including an upper support surface, mounting a first bracket in a desired bracket position to the support structure, such that said first bracket defines a first portion and a second portion defining an opening for receiving one of the pair of cross-members of the first floor panel between said first portion and said second portion, mounting a second bracket in a desired bracket position to the support structure, such that said second bracket defines a first segment and a second segment defining an opening for receiving one of the plurality of joists of the first floor panel between said first segment and said second segment, and positioning said floor panel such that one of the pair of cross-members of the first floor panel is positioned between said first portion and said second portion of said first bracket and is supported by the upper support surface of the support structure, and such that one of the plurality of joists of the floor panel is positioned between said first segment and said second segment of said second bracket.

In some embodiments, said second bracket can include a bottom alignment guide defining a plane upon which one of said plurality of joists is supportable. The method can further comprise positioning said first floor panel such that a lower surface of one of the plurality of joists of the first floor panel is supported by the bottom alignment guide.

In some embodiments, the method can further comprise mounting a third bracket in a desired bracket position to the support structure, such that said third bracket defines a first portion and a second portion defining an opening for receiving said one of the pair of cross-members of the floor panel between said first portion and said second portion, and said mounting of said third bracket comprising mounting said third bracket in a position spaced from said first bracket.

With or without the mounting of the third bracket, in some embodiments, the method can further comprise mounting another bracket, such as a fourth bracket, in a desired bracket position to the support structure, such that said fourth bracket defines a first portion and a second portion defining an opening for receiving said one of the plurality of joists of the first floor panel between said first portion and said second portion, and said mounting of said fourth bracket comprising mounting said fourth bracket in a position spaced from said second bracket.

In some embodiments, said second portion of said first bracket can be movable with respect to the first portion of said first bracket. The method can further comprise moving said second portion of the first bracket over a portion of the support structure.

In some embodiments, the method can further comprise using said first bracket to clamp onto a first side of the support structure and a second side of the support structure such that a section of the first support bracket extends below the support structure.

In some embodiments, the method can further comprise removing said first bracket and said second bracket from the support structure.

In some embodiments, the method can further comprise removing said first bracket and said second bracket from the support structure.

In some embodiments, the method can further comprise positioning the first floor panel relative to an assembled second floor panel, said second assembled floor panel including a plurality of joists extending between a first pair of sides and a pair of cross-members extending between a second pair of sides, at least one end of said pair of cross-members extending beyond an outermost of the plurality of joists, further comprising positioning said second bracket adjacent to at least one of said at least one end of said pair of cross-members and positioning said floor panel such that a portion of one of the plurality of joists of the floor panel is positioned adjacent to said at least one end of said pair of cross-members extending beyond an outermost of the plurality of joists.

Also disclosed herein are embodiments of a method of positioning at least one floor panel during construction of a building, the method comprising providing a first assembled floor panel including a plurality of joists extending between a first pair of sides and a pair of cross-members extending between a second pair of sides, locating a desired first floor panel position on a support structure for a floor panel, said support structure including an upper support surface, mounting a first bracket in a desired bracket position to the support structure, such that said first bracket defines a first portion and a second portion defining an opening for receiving one of the pair of cross-members of the first floor panel between said first portion and said second portion, mounting a second bracket in a desired bracket position to the support structure, such that said second bracket defines a first segment and a second segment defining an opening for receiving either (1) one of the plurality of joists of the first floor panel between said first segment and said second segment or (2) the other of the plurality of cross-members of the first floor panel between said first segment and said second segment, positioning said floor panel such that one of the pair of cross-members of the first floor panel is positioned between said first portion and said second portion of said first bracket and either (1) one of the plurality of joists of the first floor panel is positioned between said first segment and said second segment of the second bracket or (2) the other of the plurality of cross-members is positioned between said first segment and said second segment of said second bracket, and removing said first bracket and said second bracket from the support structure.

In some embodiments, said second portion of said first bracket can be movable with respect to the first portion of said first bracket. The method can further comprise moving said second portion of the first bracket over a portion of the support structure.

In some embodiments, the method can further comprise using said first bracket to clamp onto a first side of the support structure and a second side of the support structure such that a section of the first support bracket extends below the support structure.

In some embodiments, said second bracket can include a bottom alignment guide defining a plane upon which one of said plurality of joists is supportable. The method can further comprise positioning said first floor panel such that a lower surface of one of the plurality of joists of the first floor panel is supported by the bottom alignment guide.

In some embodiments, the method can further comprise using said first bracket to clamp onto a first side of the support structure and a second side of the support structure such that a section of the first support bracket extends below the support structure.

In some embodiments, the method can further comprise mounting a third bracket in a desired bracket position to the support structure, such that said third bracket defines a first portion and a second portion defining an opening for receiving said one of the pair of cross-members of the floor panel between said first portion and said second portion, and said mounting of said third bracket comprising mounting said third bracket in a position spaced from said first bracket.

With or without the mounting of the third bracket, in some embodiments, the method can further comprise mounting another bracket, such as a fourth bracket, in a desired bracket position to the support structure, such that said fourth bracket defines a first portion and a second portion defining an opening for receiving said one of the plurality of joists of the first floor panel between said first portion and said second portion, and said mounting of said fourth bracket comprising mounting said fourth bracket in a position spaced from said second bracket.

In some embodiments, the method can further comprise positioning the first floor panel relative to an assembled second floor panel, said second assembled floor panel including a plurality of joists extending between a first pair of sides and a pair of cross-members extending between a second pair of sides, at least one end of said pair of cross-members extending beyond an outermost of the plurality of joists, further comprising positioning said second bracket adjacent to at least one of said at least one end of said pair of cross-members and positioning said floor panel such that a portion of one of the plurality of joists of the floor panel is positioned adjacent to said at least one end of said pair of cross-members extending beyond an outermost of the plurality of joists.

In some embodiments, the method can further comprise positioning the first floor panel relative to an assembled second floor panel, said second assembled floor panel including a plurality of joists extending between a first pair of sides and a pair of cross-members extending between a second pair of sides, at least one end of said pair of cross-members extending beyond an outermost of the plurality of joists, further comprising positioning said second bracket adjacent to at least one of said at least one end of said pair of cross-members and positioning said floor panel such that a portion of one of the plurality of joists of the floor panel is positioned adjacent to said at least one end of said pair of cross-members extending beyond an outermost of the plurality of joists.

Also disclosed herein are embodiments of a floor panel seating assembly, comprising a bracket assembly, comprising a first guide portion including a first guide surface, a second guide portion including a second guide surface, and a support structure defining an upper surface, wherein the first guide surface is aligned with and extends above an outer surface of the support structure and the second guide surface is positioned over the upper surface of the support structure and is spaced from said first guide a distance corresponding to a thickness of a rim of the floor panel.

In some embodiments, the second guide portion can be secured to said first guide portion.

In some embodiments, the second guide portion can be movable with respect to said first guide portion in a direction corresponding to the thickness of the rim of the floor panel.

In some embodiments, the first guide portion can include a first support structure clamping surface and the second guide portion can define a second support structure clamping surface, wherein the first support structure clamping surface and the second support structure clamping surface cooperate to grip the support structure and secure the bracket assembly in a mounted position relative the support structure.

In some embodiments, the first guide portion can be separated from the second guide portion in a vertical direction.

Also disclosed herein are embodiments of a floor panel seating assembly, comprising a bracket assembly, comprising a first guide portion including a first guide surface, and a second guide portion including a second guide surface and a lower surface positioned to face an upper facing surface of a support structure, wherein the second guide surface extends upward with respect to the lower facing surface of the second guide portion.

In some embodiments, the second guide portion can be secured to said first guide portion.

In some embodiments, the second guide surface can be movable with respect to said first guide surface.

In some embodiments, the first guide portion can include a first support structure clamping surface and the second guide portion can define a second support structure clamping surface, wherein the first support structure clamping surface and the second support clamping surface are moveable.

In some embodiments, the first guide portion can be separated from the second guide portion in a direction parallel to said first guide surface.

Also disclosed herein are embodiments of a floor panel seating assembly, comprising a bracket assembly, comprising a first guide portion including a first guide surface, a second guide portion including a second guide surface, and a support structure defining an upper surface, wherein the first guide surface and the second guide surface extend above the upper surface of the support structure, and wherein further the first guide surface extends above the second guide surface and is spaced from said first guide surface a distance corresponding to a thickness of a floor joist of a floor panel.

In some embodiments, the bracket assembly can further comprise a mounting flange extending below the upper surface of the support structure.

In some embodiments, the second guide portion can be movable with respect to said first guide portion in a direction corresponding to the thickness of the a floor joist of the floor panel.

Also disclosed herein are embodiments of a floor panel seating assembly, comprising a bracket assembly, comprising a first guide portion including a first guide surface, and a second guide portion including a second guide surface, wherein the first guide surface extends above the second guide surface and the second guide portion is movable with respect to said first guide portion in a direction corresponding to the thickness of the a floor joist of the floor panel.

In some embodiments, the bracket assembly can further comprise a mounting flange extending below an upper surface of a support structure.

Also disclosed herein are embodiments of a floor panel seating assembly, comprising a beam including a lower surface and a side surface configured to mate with a mating surface of a ledger, and a ledger guide, comprising an upwardly facing mounting surface facing said lower surface of said beam, an upwardly facing bottom alignment guide defining a plane upon which the ledger is positionable, and a first guide portion including a first guide surface extending above said mounting surface and spaced from said side surface of the beam a distance corresponding to a thickness of the ledger.

DETAILED DESCRIPTION

Figure 1:
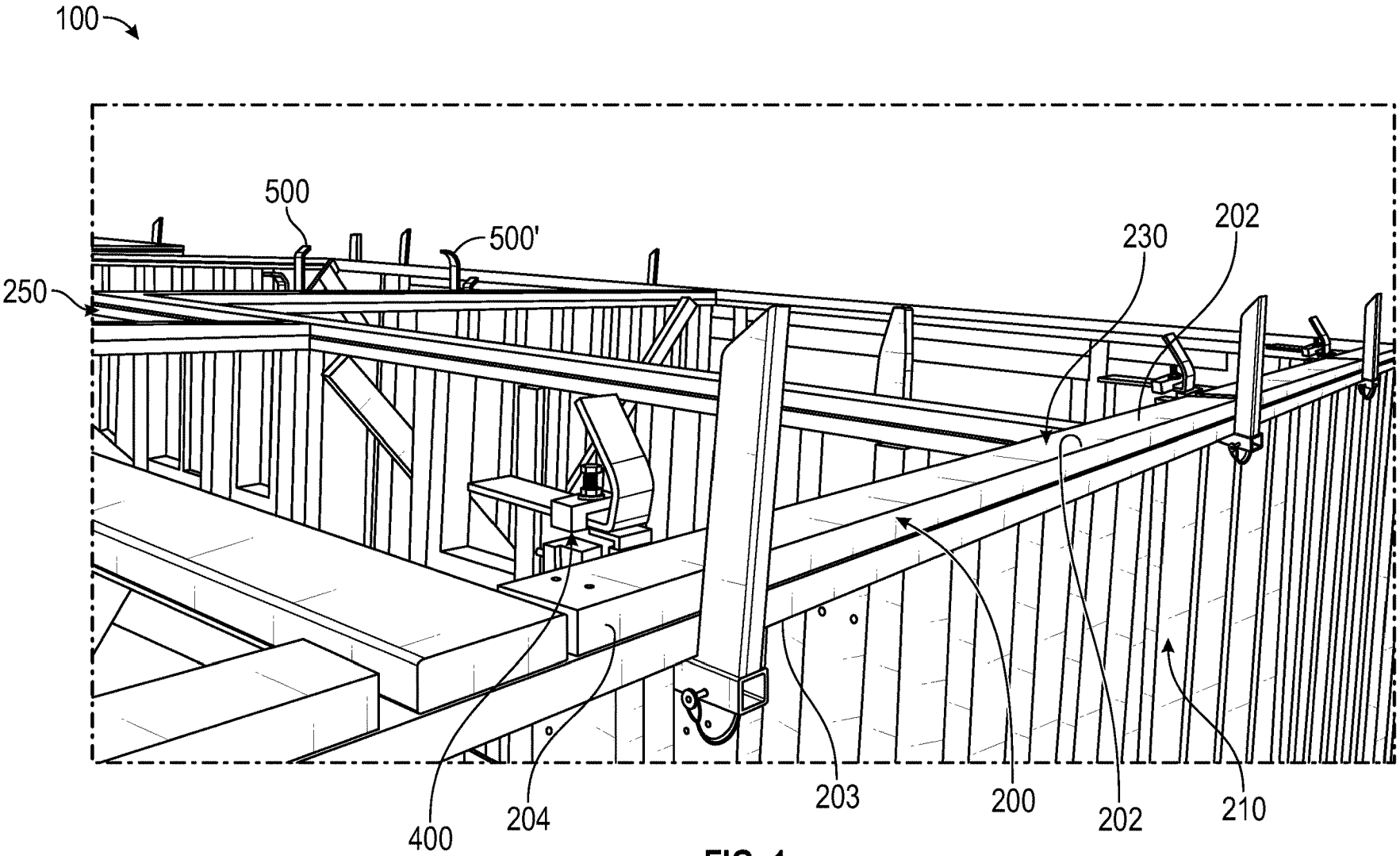
FIG. 1 illustrates an embodiment of a floor panel seating assembly.

Disclosed herein are embodiments of a floor panel seating assembly and brackets and/or guides for seating (e.g., guiding/positioning) a floor panel during construction of a building. The floor panel seating assembly can make it easier, faster, and safer to land floor panels in their desired positions. The guides can be removable and reusable within a single job and over the course of multiple jobs. The floor panel seating assembly can advantageously accommodate different support structure configurations (including different sized top plates of walls) and different sized floor panels due to the adjustability of the guides. The guides can allow for more consistent alignment of floor panels and can allow for installation of the floor panels to be carried out from the interior of the structure, which makes the process of installing floor panels safer. The floor panel seating assembly, hoisted by a crane, can desirably support loads of at least 1,000 lbs, or 2,500 lbs, or 3,000 lbs. The floor panel seating assembly can be moved at a speed of least 2 ft/s, or 3 ft/s, or 4 ft/s. The resulting load can be between 4 kN-8 kN.

Also disclosed herein are embodiments of a method of positioning and seating a floor panel during construction. Desirably, the method incorporates using a bracket/guide, or a combination of brackets/guides, to guide and seat a floor panel during construction of a building. The method of using the bracket(s)/guide(s) to guide and seat a floor panel during construction of a building described herein desirably can increase the degree of accuracy/precision in positioning the floor panel and reduce the likelihood of error in positioning the bracket(s)/guide(s) and/or seating the floor panel.

The placement of the bracket(s) desirably can be easily modified. The bracket(s) desirably can be removable and/or are not fixed relative to other brackets/guides. The bracket(s) desirably can be reusable. For example, the bracket(s) desirably can be used to guide a particular floor panel into position, removed, then reused to guide another floor panel into position.

The structure of the bracket(s) desirably can make bracket installation easier and faster. For example, a driver adjuster desirably can make bracket installation faster than tightening/adjusting brackets by hand.

The method desirably can make it easier and faster to position a floor panel. The method desirably can be a "drop and go" approach to seating floor panels. Without using the bracket(s) described herein to guide a floor panel into place, it can take 15 minutes on average (e.g., between 10-20 minutes) to place a floor panel using a single crane, a signal worker, and a team of six installers manually guiding the floor panels. Using the bracket(s) described herein to guide a floor panel into place, it can take 4 minutes on average to place a floor panel (e.g., between 3-9 minutes). The floor panel seating assembly makes it possible to lay at least 3,000-4,500 $ft^2$ of floor panels in a given day using a single crane, a signal worker, and a team of two installers guiding the floor panels.

Installation of the brackets and installation of the floor panels is often safer when using the bracket(s) and method described herein rather than guiding floor panels into position solely by hand (without hardware). For example, desirably the user can maintain his or her center of gravity on the center of a ladder during installation of the brackets. Floor panel installation can also be safer because the brackets desirably secure the floor panels in place and prevent shifting of the floor panels during mounting.

Figure 21:
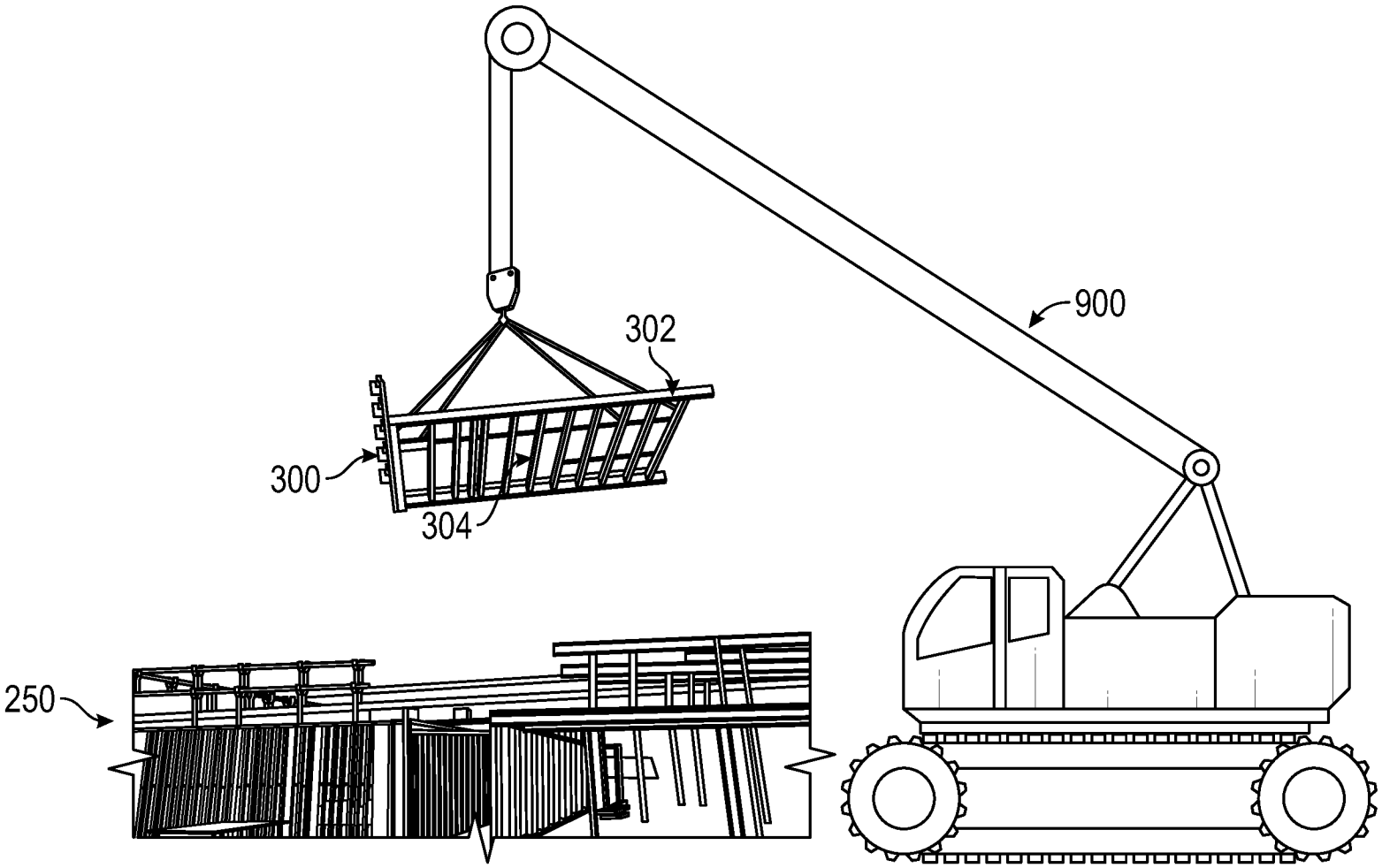
FIG. 21 illustrates an embodiment of a floor panel being lowered by a crane towards a support structure.

The method desirably can include the following steps, in no particular order:

Provide an assembled floor panel (FIG. 21)

Locate the desired position on the support structure for the floor panel

Figure 17:
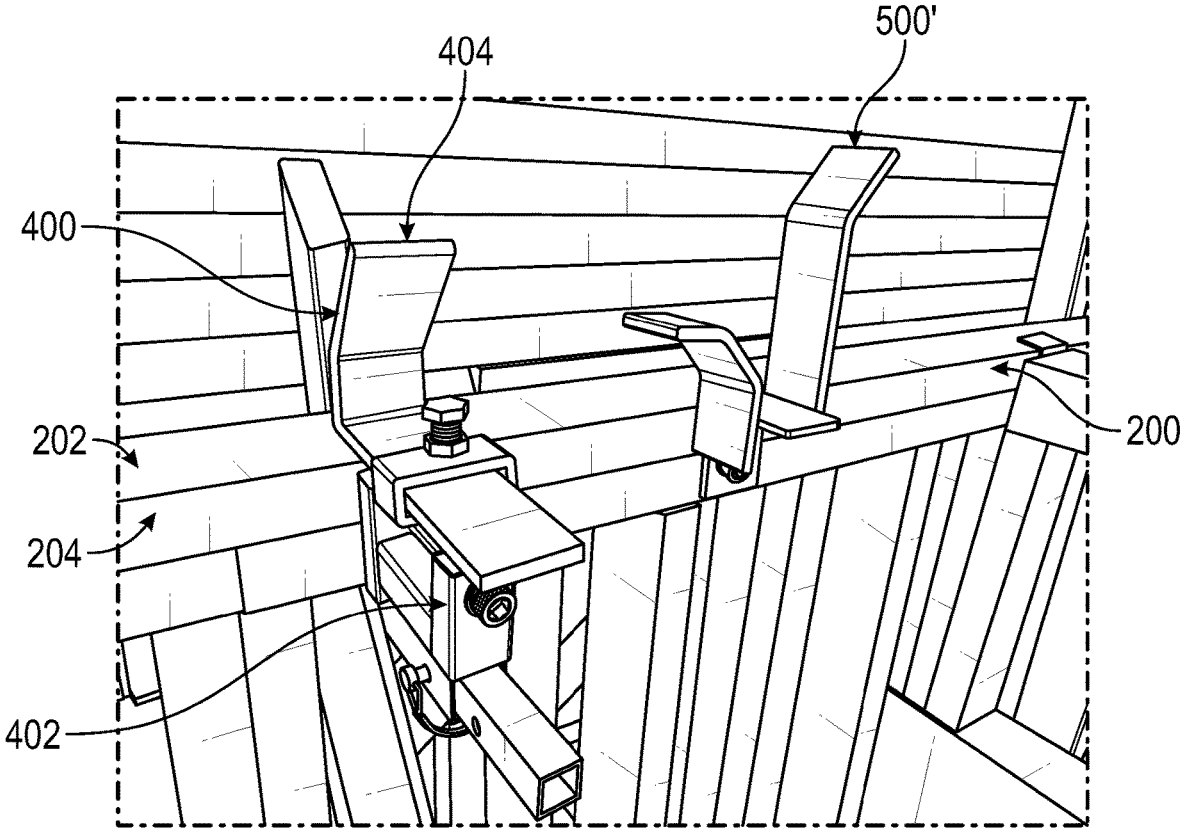
FIG. 17 illustrates a rim guide and a joist guide mounted on a top plate of a wall of a support structure.
Figure 18:
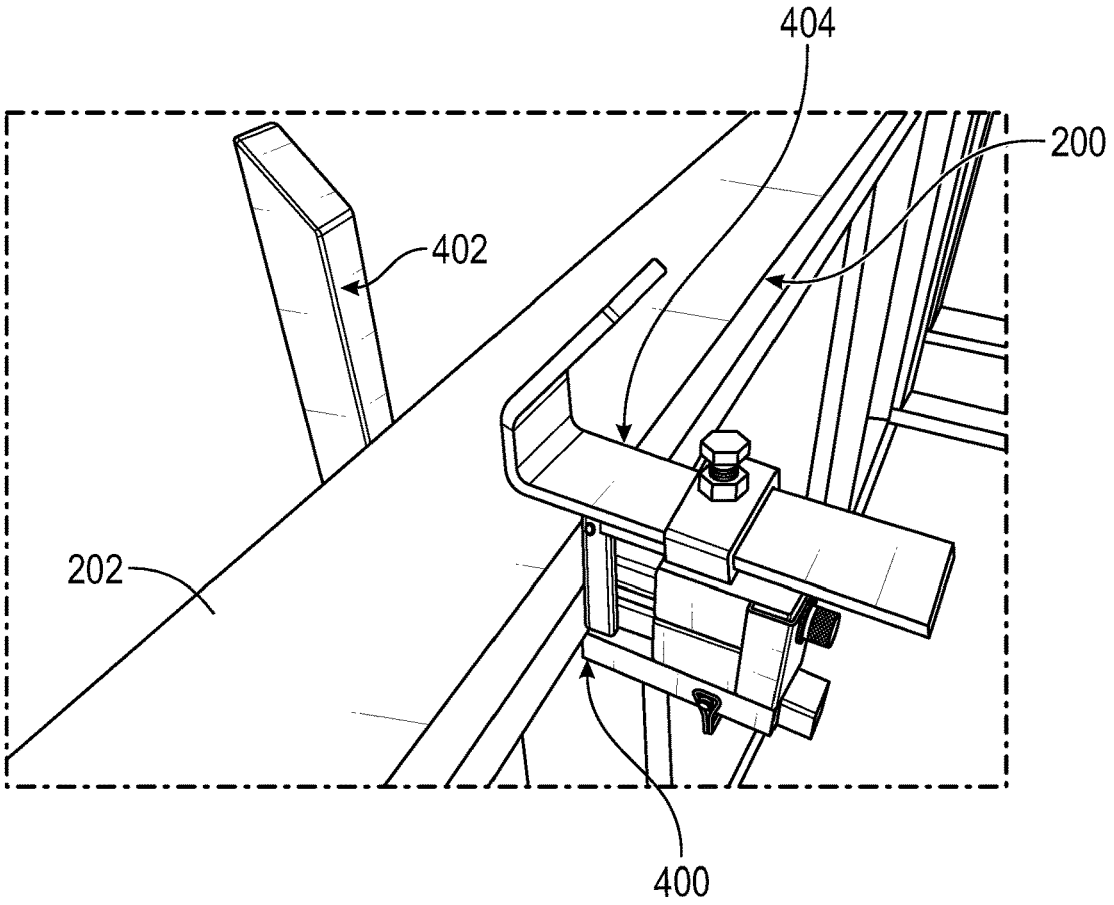
FIG. 18 illustrates a rim guide mounted on a top plate of a wall of a support structure.
Figure 19:
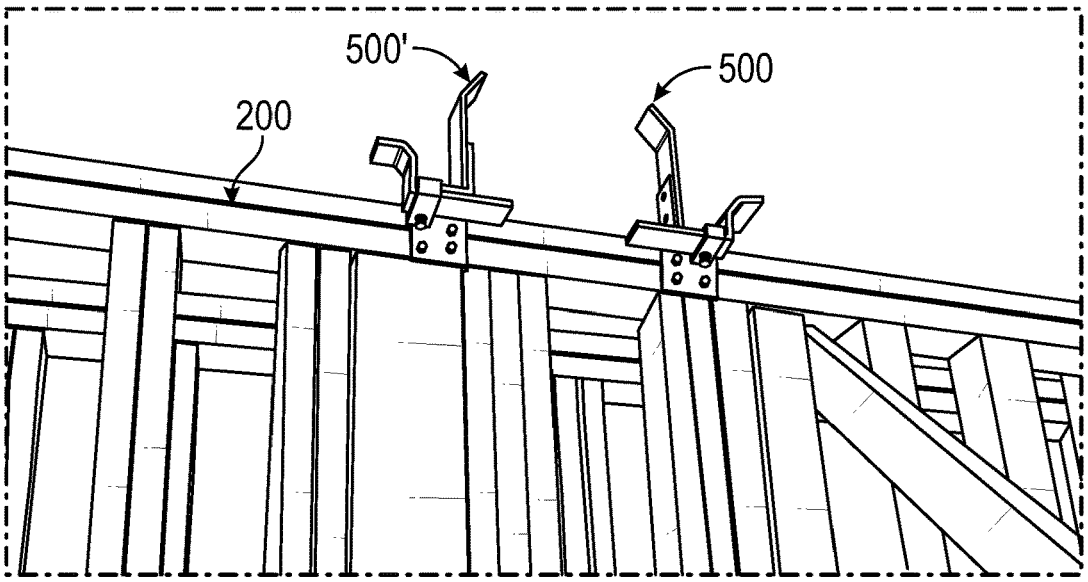
FIG. 19 illustrates two joist guides spaced apart and mounted on a top plate of a wall of a support structure.

Mount bracket(s) in desired position(s) to the support structure (FIGS. 17-19)

Figure 25:
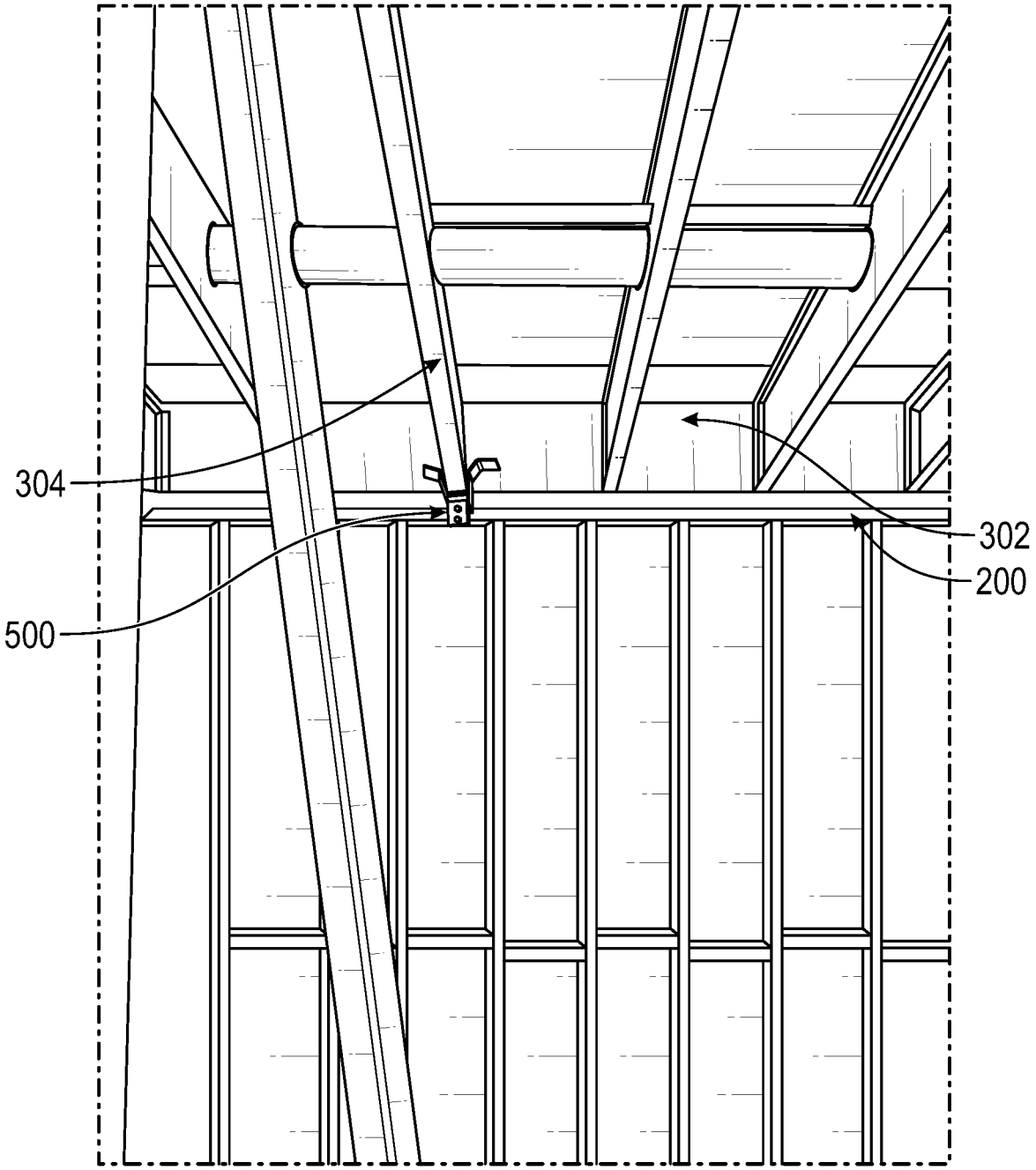

(Optionally) Mount bracket(s) in desired position(s) on a second end of the support structure (FIG. 25)

(Optionally) Mount bracket(s) in desired position(s) on a third end of the support structure The method desirably can include providing a removable bracket, adjusting the bracket to accommodate different joist/wall/rim sizes, mounting the bracket in position, and lowering an assembled floor panel such that the outer perimeter of the floor panel aligns with the bracket (e.g., aligns with an inner surface of the bracket).

FIG. 1 illustrates a floor panel seating assembly 100 mounted on a support structure 250. In some embodiments, the floor panel seating assembly 100 includes the support structure 250. As illustrated, a portion of the support structure 250 may include an outer wall 230, including vertically extending studs 210 and a top plate 200, such as the double top plate shown (FIG. 1). The top plate 200 can be the top horizontal member(s) of external and internal bearing walls. The top plate 200 can define an upper surface 202, a bottom surface 203, and an outer surface 204 (FIG. 1).

Figure 2A:
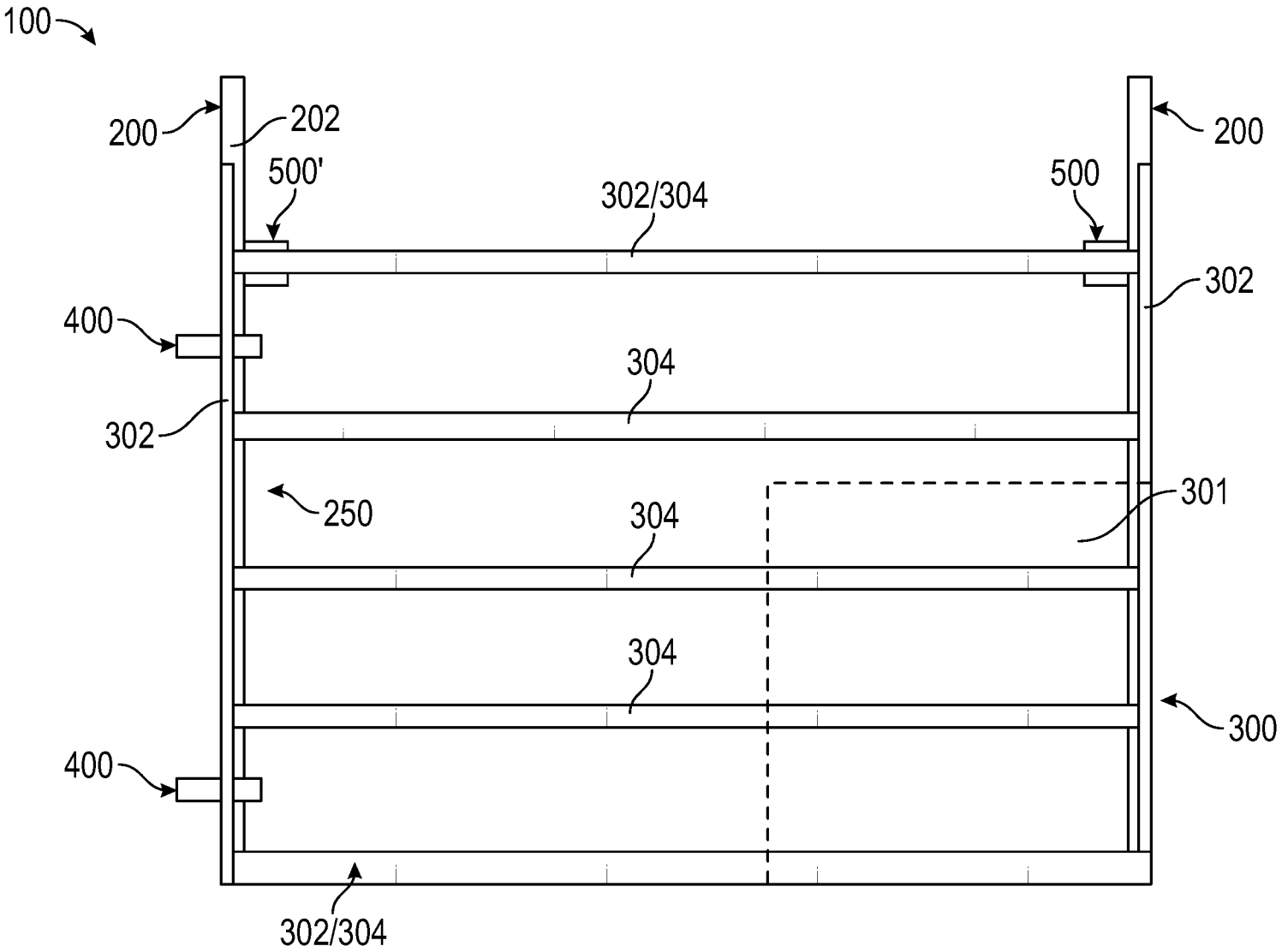
FIG. 2A illustrates another embodiment of a floor panel seating assembly with a floor panel.

FIG. 2A illustrates a floor panel 300 seated on top of a pair of top plates 200, 200 of walls of a support structure 250. The floor panel 300 can include a plurality of cross-members 302, a plurality of joists 304 extending between the cross-members 302, and an upper sheet 301 extending over the cross-members 302 and joists 304 (only a portion of the upper sheet 301 being shown in FIG. 2A for purposes of illustrating other features beneath the upper sheet 301). As illustrated, in some embodiments, a portion of the cross-member 302 can extend beyond the outermost joist 304 on at least one side of the floor panel 300. As indicated in FIG. 2A, depending on what is compatible with the relevant portion of the support structure 250, the outermost support member of the floor panel 300 can be a cross-member 302 or a joist 304. Generally speaking a rim is supported along its entire length whereas a portion, often substantially the entire length (i.e., at least 90% of the length), of a joist is unsupported from beneath, spanning between supported portions of the floor panel. In some embodiments, the floor panels could have other configurations and those of skill in the art will appreciate that aspects of the disclosed apparatus and methods could still provide some advantages.

Figure 2B:
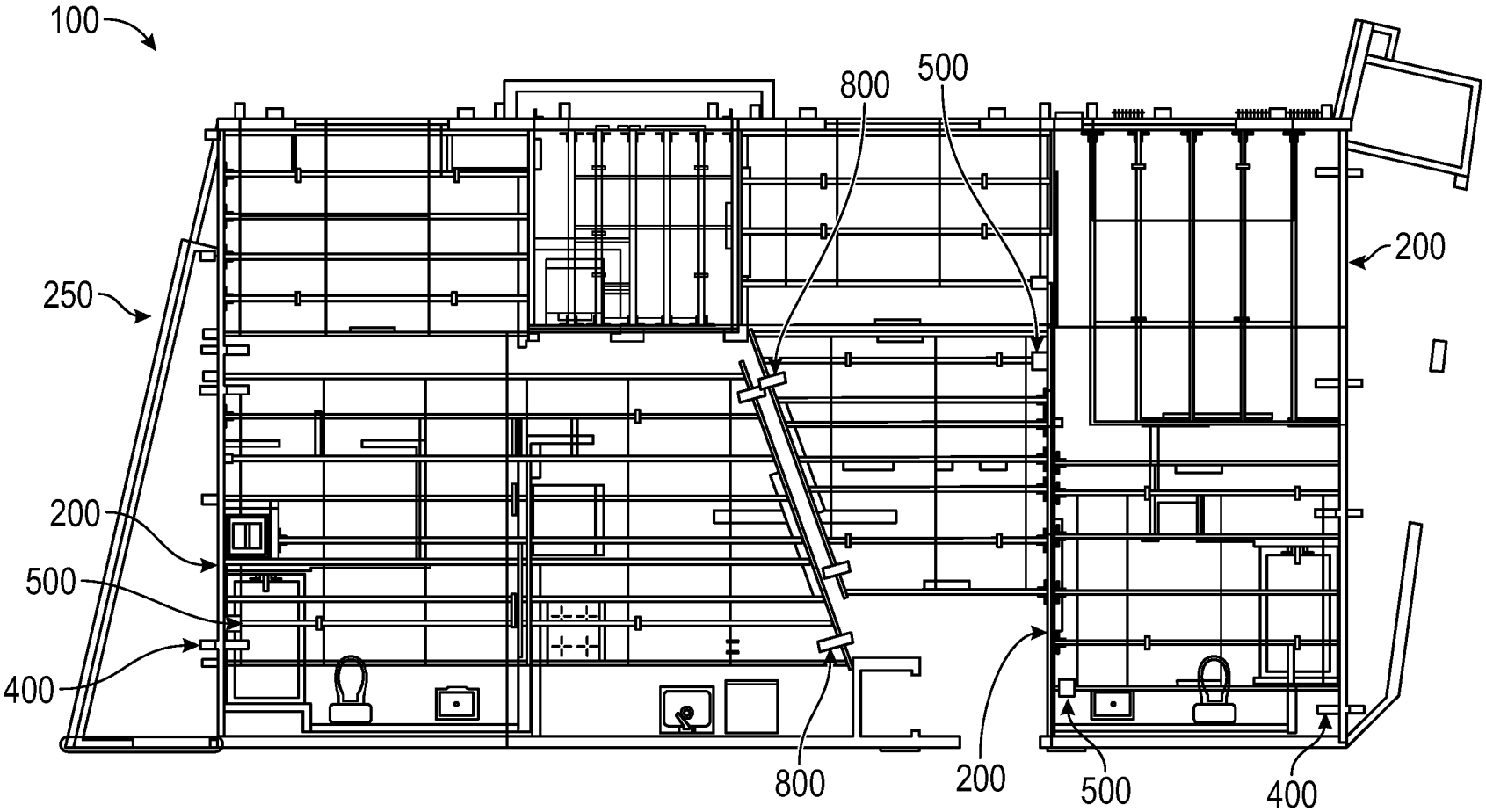
FIG. 2B illustrates an embodiment of a floor plan indicating relative positions of components of a floor panel seating assembly.

The floor panel seating assembly 100 can include a variety of brackets and guides. For example, the floor panel seating assembly 100 can include a combination of one or more rim guide assemblies 400 (FIG. 29), joist guides 500 (FIG. 19), and/or ledger guides 800 (FIG. 39), each of which will be described in greater detail below. FIG. 2B illustrates a top view of an example floor plan, which shows possible positions for mounting one or more rim guide assemblies 400, joist guides 500, and/or ledger guides 800 to a support structure 250. As shown in FIG. 2A and in the lower left-hand corner of the floor plan of FIG. 2B, in some instances, a rim guide assembly 400 and a joist guide 500 are mounted adjacent to one another along the length of the same top plate 200. As shown in FIG. 2A and in the lower right-hand corner of the floor plan of FIG. 2B, in some instances, a rim guide assembly 400 and a joist guide 500 are mounted to different, spaced apart top plates 200 of walls.

The rim guide assembly 400 can be configured to attach to a top plate 200 of a wall and to guide a cross-member of a floor panel into place. Portions of the rim guide assembly 400 can be adjustable to accommodate different wall plates (e.g., different wall plate widths) and/or floor cross-member (e.g., different floor cross-member widths). For example, a portion of the rim guide assembly 400 can be configured to slide to accommodate different widths of wood, such as floor panel 300, on top of a support structure 250. The joist guide 500 can be configured to attach to a top plate 200 of a wall and to guide a joist of a floor panel into place. Portions of the joist guide 500 can be adjustable to accommodate different floor joist sizes. The adjustability of the rim guide assembly 400 and/or joist guide 500 allows the guides to accommodate various support structure configurations and various floor panel configurations.

The bracket(s) desirably can include an angled segment (e.g., a portion bent at an angle with respect to a vertical portion) such that when the floor panel is lowered, a wider aperture is available to guide the floor panel into place. The floor panel desirably can be lowered along an outer face of the angled segment of the bracket. This desirably can allow for increased visibility of the floor panel as it is being positioned.

Rim Guide Assembly

Figure 3:
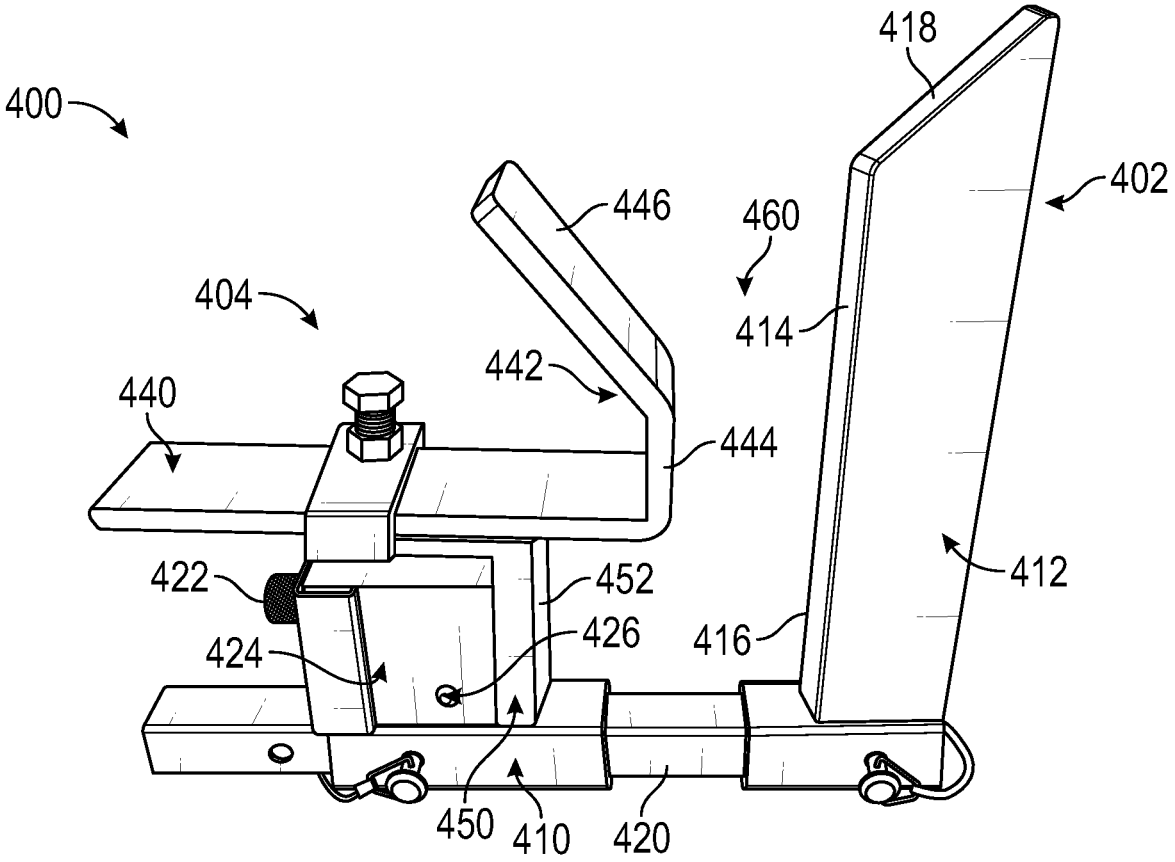
FIGS. 3-4 are side views of an embodiment of a rim guide.
Figure 4:
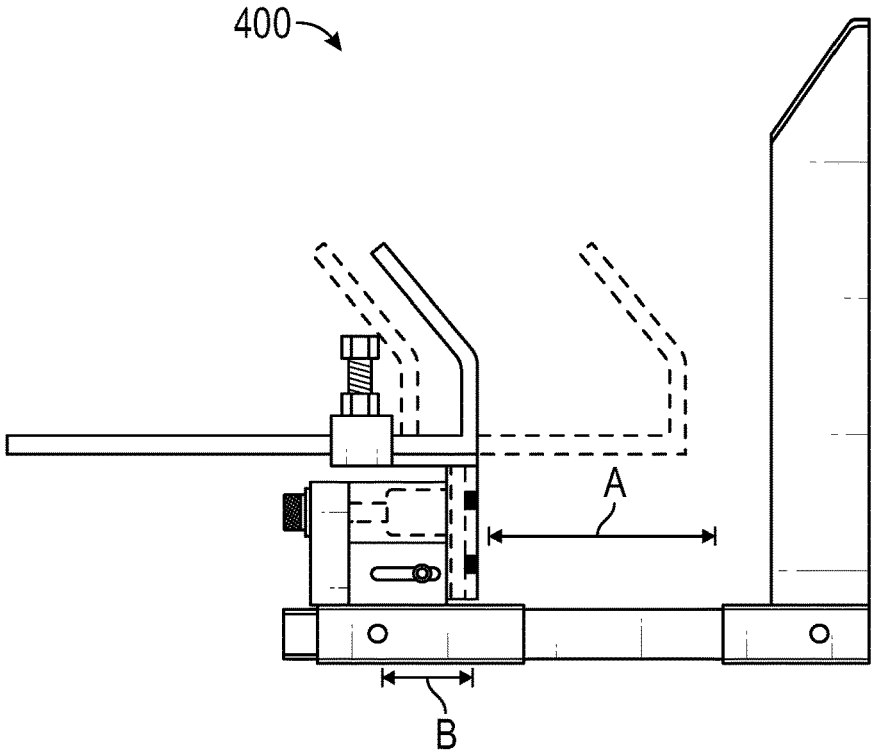
Figure 5:
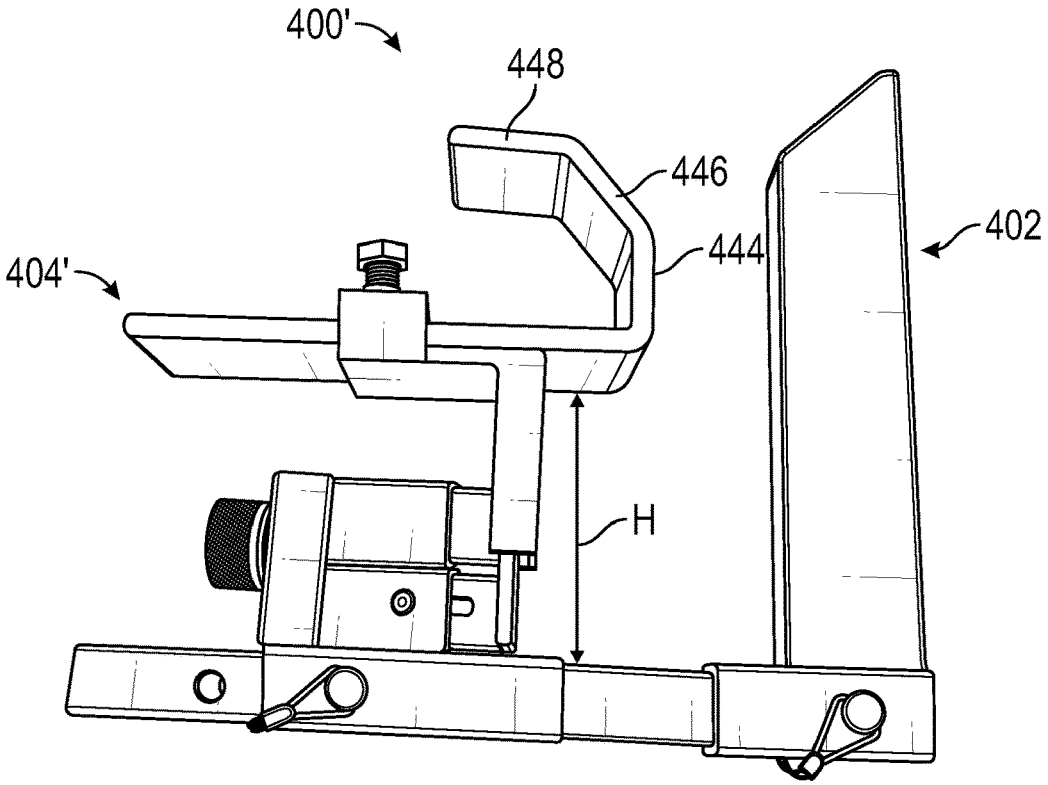
FIG. 5 is a side view of another embodiment of a rim guide.

FIGS. 3-4 illustrate an embodiment of a cross-member guide assembly or rim guide assembly 400. The rim guide assembly 400 can include a first portion or main body 402 and a second portion or mount body 404. The rim guide assembly 400' (shown in FIG. 5) is an alternative embodiment, which includes an alternative mount body 404' (shown in FIGS. 5 and 12). In some embodiments, the main body 402 and the mount body 404 are integral. Features described in the context of the main body 402 may be located on the main body 402 and/or the mount body 404. Features described in the context of the mount body 404 may be located on the mount body 404 and/or the main body 402. In some embodiments, as illustrated, the mount body 404 can be attached to and detached from the main body 402. The main body 402 and the mount body 404 can define an opening 460 for receiving the cross-member of a floor panel when the main body 402 and mount body 404 are coupled (or integral).

The rim guide assembly 400 desirably can allow the cross-member of the floor panel being positioned to be supported on its base and both of its vertical sides (e.g., the base of the cross-member of the floor panel abutting the top surface of the wooden support structure 250 (e.g., the upper surface 202 of the top plate 200) and the vertical sides of the cross-member of the floor panel abutting portions of the rim guide assembly 400).

Main Body

Figure 8:
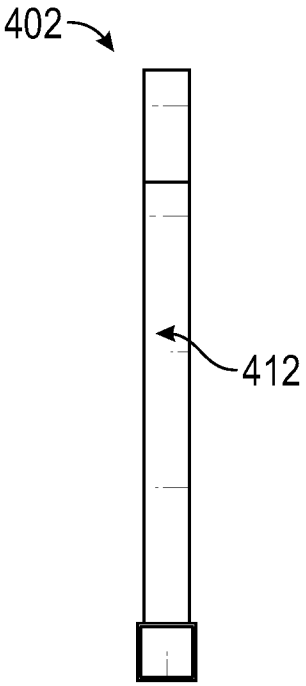
FIGS. 6-8 are different views of the first portion of the rim guide of FIG. 3.
Figure 7:
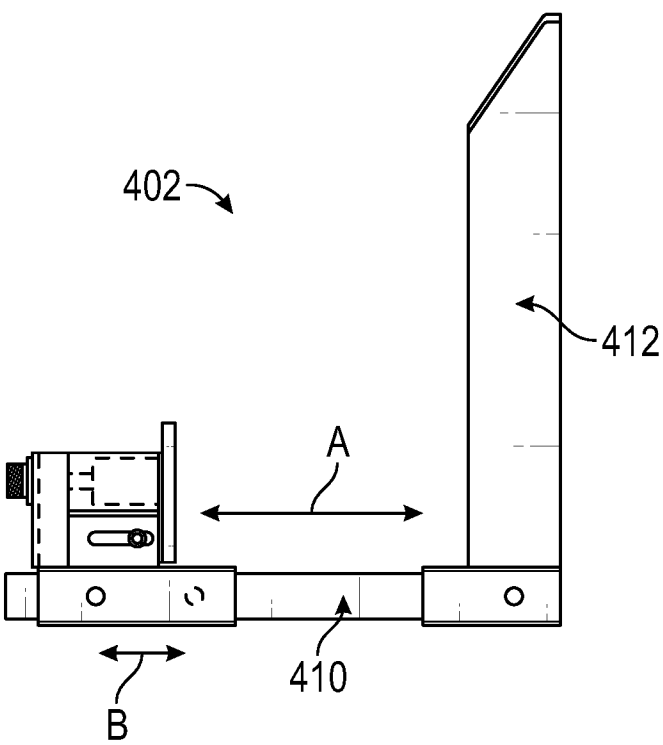
Figure 6:
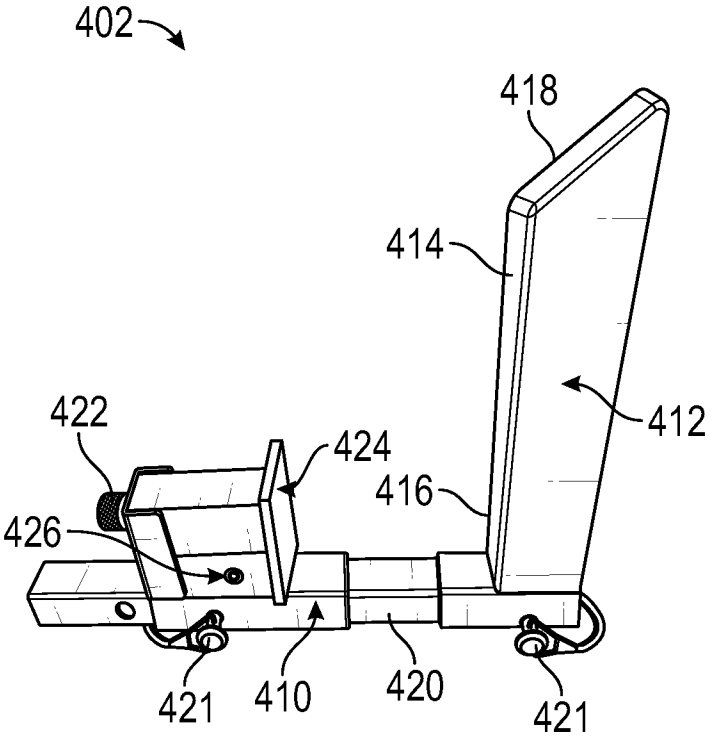

As shown in FIGS. 6-8, the first portion or main body 402 can include a horizontal section 410, an upwardly extending section or arm 412, and/or a support 424. As shown in FIG. 7, the main body 402 can be adjusted to accommodate different support structure 250 configurations, including wall 230 widths of at least 3", or 4", or 5" (As used herein, this should be understood to mean at least 3", at least 4" or at least 5".). The main body 402 can be adjusted to accommodate wall 230 widths of less than 10", or 7", or 6".

Macro adjustment of the rim guide assembly 400 can be provided along path A and fine adjustment of the rim guide assembly 400 can be provided along path B (FIG. 7). The macro adjustment can be at least 1", or 4", or 6". The macro adjustment can be less than 10", or 9", or 8". The macro adjustment can be applied in increments of at least ¼", or ½", or 1". The macro adjustment can be applied in increments of less than 4", or 2", or 1.5". The macro adjustment may be selected to correspond to a distance that is slightly larger than the expected width of the wall 230.

The fine adjustment can be at least 1/10", or ⅛", or ¼". The fine adjustment can be less than 2.5", or 1", or ½". The fine adjustment can be applied in increments of at least 1/10", or ⅛", or ¼". The fine adjustment may be selected to more precisely correspond to the width of the wall 230.

The distance between the arm 412 and the support 424 can be adjusted (e.g., the distance can be at least 3", or 4", or 5", or the distance can be less than 10", or 8", or 6"). As illustrated in FIG. 7, the support 424 can move along paths A and/or B. The support 424 can be movable along a track 420, towards and/or away from the arm 412 along path A. The main body 402 can include fasteners 421 to secure the relative positions of the arm 412 and the support 424 along path A. As illustrated in FIG. 6, the fasteners 421 can be pins that can slide into spaced apart apertures in the horizontal section 410 of the main body 402, where the apertures define distances at which the support 424 can be secured relative to the arm 412 along path A. The positions of the apertures may correspond to distances that are slightly larger than common widths of walls to allow for convenient macro adjustments of the rim guide assembly 400.

The position of the support 424 can be adjusted along path B by rotating a fastener, such as a bolt 422, that is coupled to the support 424. In some embodiments, use of the fasteners 421 prevents movement of the support 424 along path A but does not inhibit movement of the support 424 along path B.

The lower portion of the arm 412 can define a first support structure clamping surface 416. The first support structure clamping surface 416 can abut (e.g., grip) the outer surface 204 of the top plate 200. The upper portion of the arm 412 can define a first guide surface 414 and an angled surface 418. The first guide surface 414 can help guide a cross-member of a floor panel into position. The angled surface 418 can advantageously reduce the risk that the arm 412 will interfere with or block the cross-member of the floor panel, or otherwise make it more difficult to lower the floor panel into place.

A portion of the main body 402 can be compatible with, and configured to coupled to, a portion of the mount body 404. For example, the support 424 can include a projection configured to be received in a portion of the mount body 404 (e.g., a slot or channel), or the support 424 can include an opening configured to receive a projection on the mount body 404. The support 424 can include a safety 426 that prevents inadvertent disassembling of the mount body 404 from the main body 402 when loosening the bolt 422 and/or prevents unnecessary wear to components of the rim guide assembly 400 when tightening the bolt 422. In some embodiments, tightening the bolt 422 of the main body 402 tightens the mount body 404 to the main body 402 when the mount body 404 is coupled to the main body 402.

Mount Body

As shown in FIGS. 9-12, the second portion or mount body 404 can include a vertical segment and an angled segment. As shown in FIGS. 9-12, the mount body 404 can include a horizontal section 440, an upwardly extending section or arm 442, and/or a downwardly extending section or arm 450. The mount body 404 can be adjusted to accommodate different configurations of floor panels (e.g., floor panels of different heights and widths). For example, as illustrated by the arrow H shown in FIG. 5, the height of the rim guide assembly 400 can be adjusted. The relative positions of the main body 402 and mount body 404 can be adjustable. For example, the mount body 404 can be moved up and down relative to the base of the main body 402 along a vertical axis and/or the main body 402 can be moved up and down relative to the mount body 404 along the vertical axis.

Figure 9:
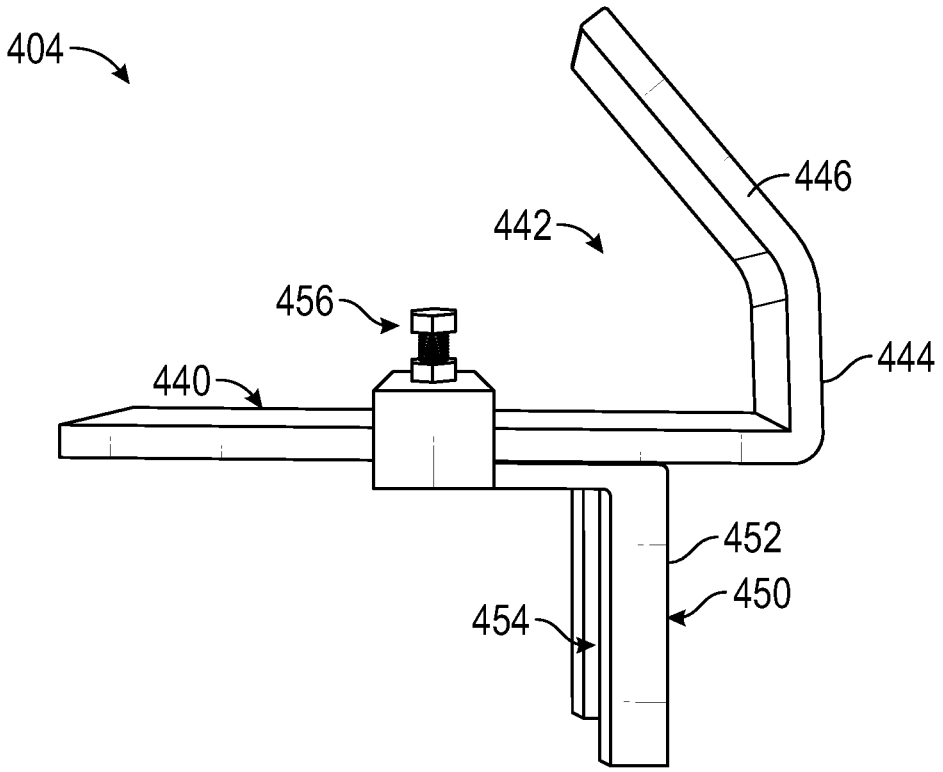
FIGS. 9-11 are side views of the second portion of the rim guide of FIG. 3.
Figure 10:
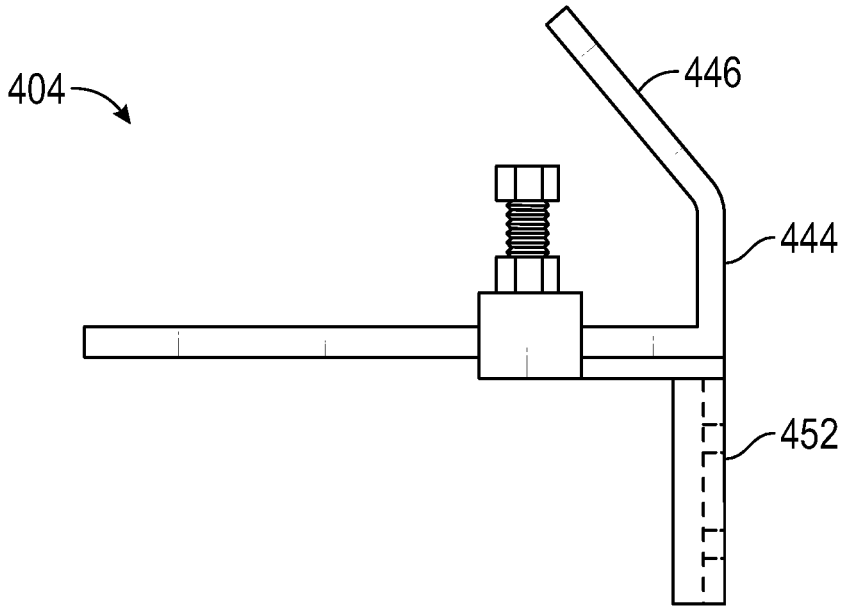
Figure 11:
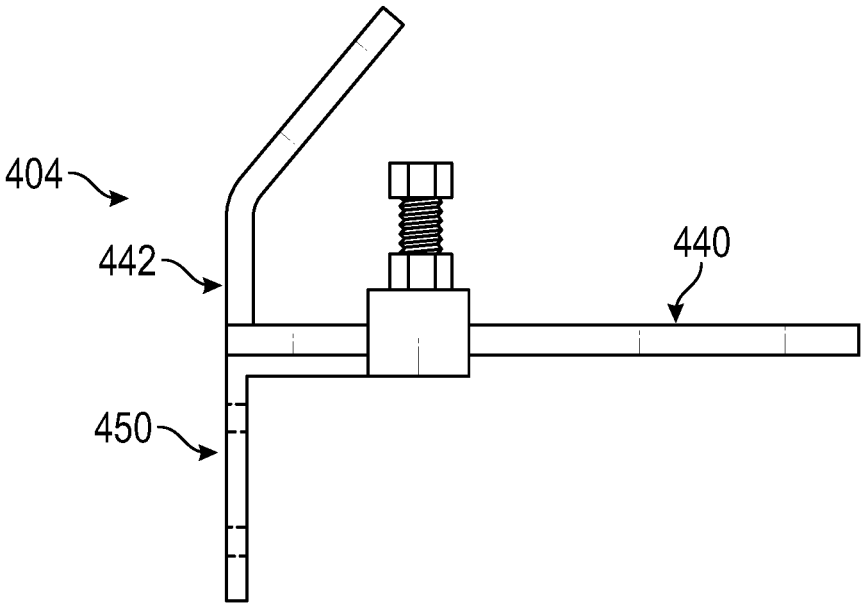
Figure 12:
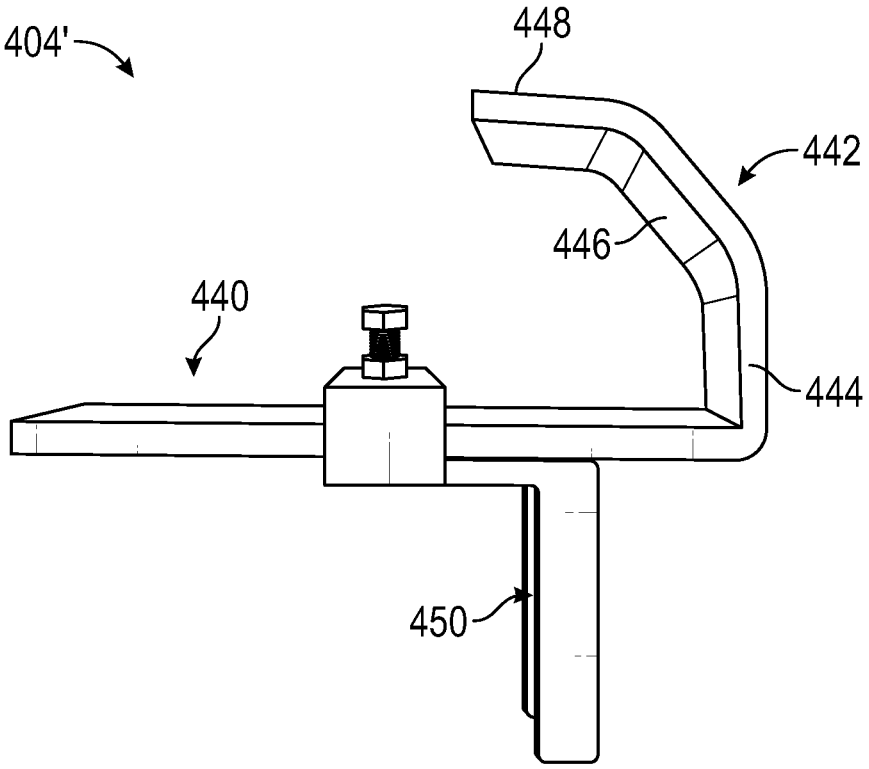
FIG. 12 is a side view of the second portion of the rim guide of FIG. 5.

The mount body 404 can be adjusted to accommodate different sized floor panel cross-member widths, such as floor panel cross-member widths of at least 1.5", or 2", or 3". The mount body 404 can accommodate floor panel cross-member widths of less than 7", or 5", or 4". The upwardly extending arm 442 can move transverse to the downwardly extending arm 450. For example, as illustrated in FIGS. 10-11, the upwardly extending arm 442 and the downwardly extending arm 450 can be aligned along the same vertical plane. As illustrated in FIGS. 9 and 12, the upwardly extending arm 442 and the downwardly extending arm 450 can be offset. For example, as shown in FIG. 9, the upwardly extending arm 442 can extend transversely beyond the downwardly extending arm 450 (toward the arm 412 when the main body 402 and the mount body 404 are coupled or integral, FIG. 3).

Loosening the fastener 456 can allow the horizontal section 440 of the mount body 404 to slide towards and away from the arm 412 of the main body 402. For example, loosening the fastener 456 can enable the upwardly extending arm 442 to slide transverse to the downwardly extending arm 450 along the longitudinal axis of the mount body 404 (e.g., toward or away from the arm 412 when the first portion or main body 402 and the second portion or mount body 404 are coupled or integral). Tightening the fastener 456 can fix the relative positions of the upwardly extending arm 442 and the downwardly extending arm 450. The horizontal section 440 and/or the upwardly extending arm 442 can be movable along the longitudinal axis of the mount body 404 by at least 0.01", or 0.5", or 1", or 2", or 3" or 4". The horizontal section 440 and/or the upwardly extending arm 442 can be movable along the longitudinal axis by less than 10", or 8", or 5".

As illustrated in FIGS. 9-12, the downwardly extending arm 450 can define a second support structure clamping surface 452. The second support structure clamping surface 452 can abut (e.g., grip) a lateral surface of the top plate 200 (such as the lateral surface of the top plate 200 opposite the outer surface 204). The first support structure clamping surface 416 does not need to be located on the first portion or main body 402 and the second support structure clamping surface 452 does not need to be located on the second portion or mount body 404. For example, in some embodiments, both the first and second support structure clamping surfaces 416, 452 can be defined by the main body 402.

As illustrated in FIG. 9, the upwardly extending arm 442 can define a second guide surface 444 and an angled surface 446. In some embodiments, as illustrated in FIG. 12, the upwardly extending arm 442 can define a second guide surface 444 and multiple angled surfaces 446, 448. The second guide surface 444 can help guide a cross-member of a floor panel into position. The angled surface(s) 446, 448 can reduce the risk that the upwardly extending arm 442 will interfere with or block the cross-member of the floor panel, or otherwise make it more difficult to lower the floor panel into place.

A portion of the mount body 404 can be compatible with, and configured to couple to, a portion of the main body 402. For example, the downwardly extending arm 450 can include a mating feature, such as a slot 454 (as shown in FIG. 9) or a protrusion that can couple to a corresponding mating feature on the main body 402, such as a protrusion or a slot, respectively.

Joist Guide

Figure 14:
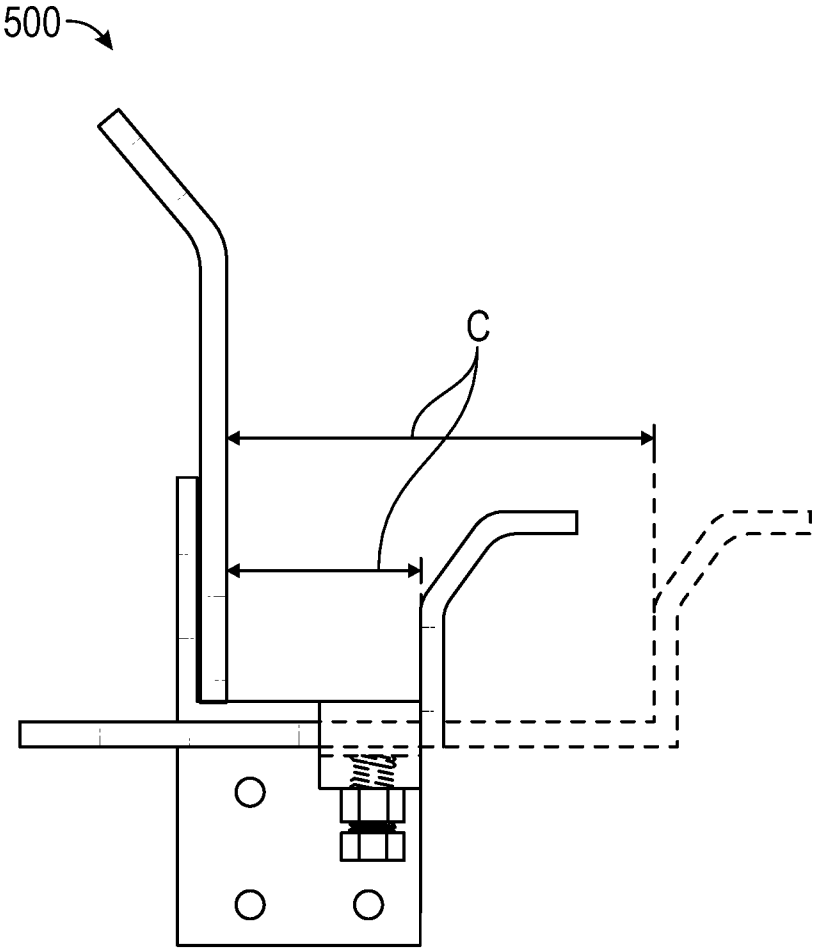
FIGS. 13-14 are different views of an embodiment of a joist guide.
Figure 16:
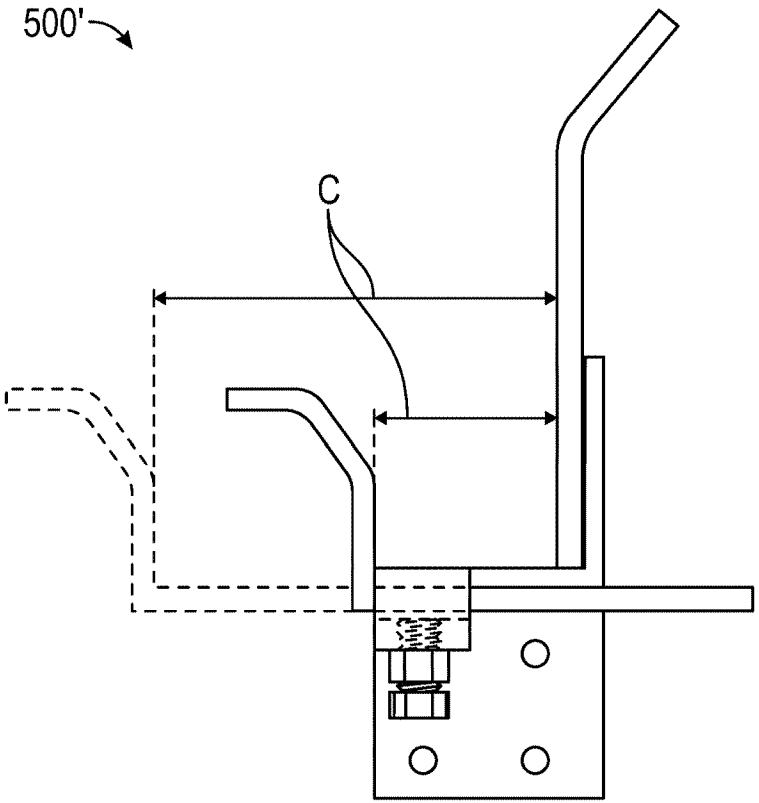
FIGS. 15-16 are different views of another embodiment of a joist guide that has the same features as the joist guide of FIGS. 13-14 but facing in the opposite direction.
Figure 15:
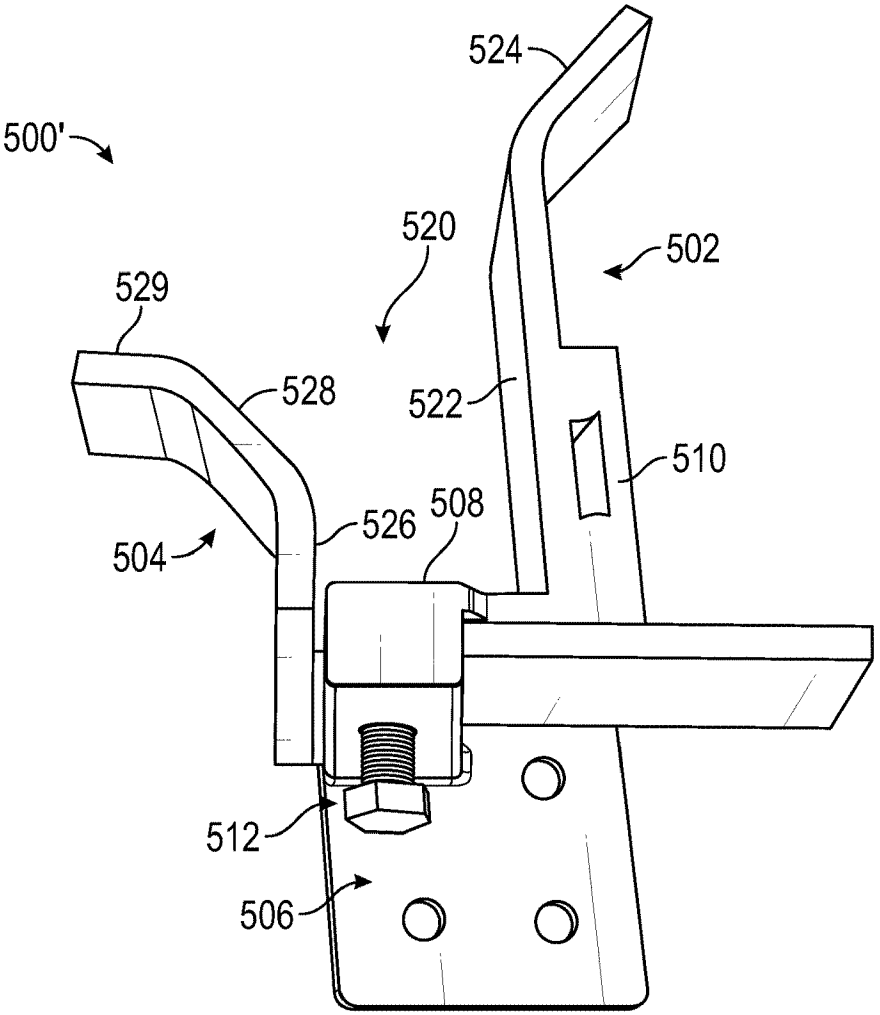

FIGS. 13-16 illustrate embodiments of a joist guide 500, 500'. The features of the joist guide 500' shown in FIGS. 15-16 are the same as those described with respect to the joist guide 500 shown in FIGS. 13-14, except that the features of the joist guide 500' face in the opposite direction from the features of the joist guide 500.

The joist guide 500 can include a first segment 502, a second segment 504, a mounting flange 506, and/or a bottom alignment guide 508. The space between the first segment 502 and the second segment 504 can define an opening 520 configured to receive a joist of a floor panel. The joist guide 500 can be adjusted to accommodate floor panel joists of different widths, such as joist widths of at least 1", or 2", or 3", or 4", or 5", or 6" or 8". The joist guide 500 can be adjusted to accommodate joist widths of less than 5", or 4", or 3.5". For example, as illustrated in FIG. 14, the second segment 504 can be moved relative to the first segment 502 (e.g., the second segment 504 can be moved towards and/or away from the first segment 502). The second segment 504 can be spaced a distance C (as shown in FIG. 14) from the first segment 502 of at least 0.5", or 1", or 1.5". The second segment 504 can be spaced a distance C from the first segment 502 of less than 6", or 5", or 4".

The first segment 502 of the joist guide 500 can define a first guide surface 522 and an angled surface 524. The first guide surface 522 can help guide a joist of a floor panel into position. The angled surface 524 can reduce the risk that the first segment 502 will interfere with or block the joist of the floor panel, or otherwise make it more difficult to lower the joist into place.

The second segment 504 of the joist guide 500 can define a second guide surface 526 and angled surface(s) 528, 529. The second guide surface 526 can help guide a joist of a floor panel into position. The angled surface(s) 528, 529 can reduce the risk that the second segment 504 will interfere with or block the joist of the floor panel, or otherwise make it more difficult to lower the joist into place.

Figure 13:
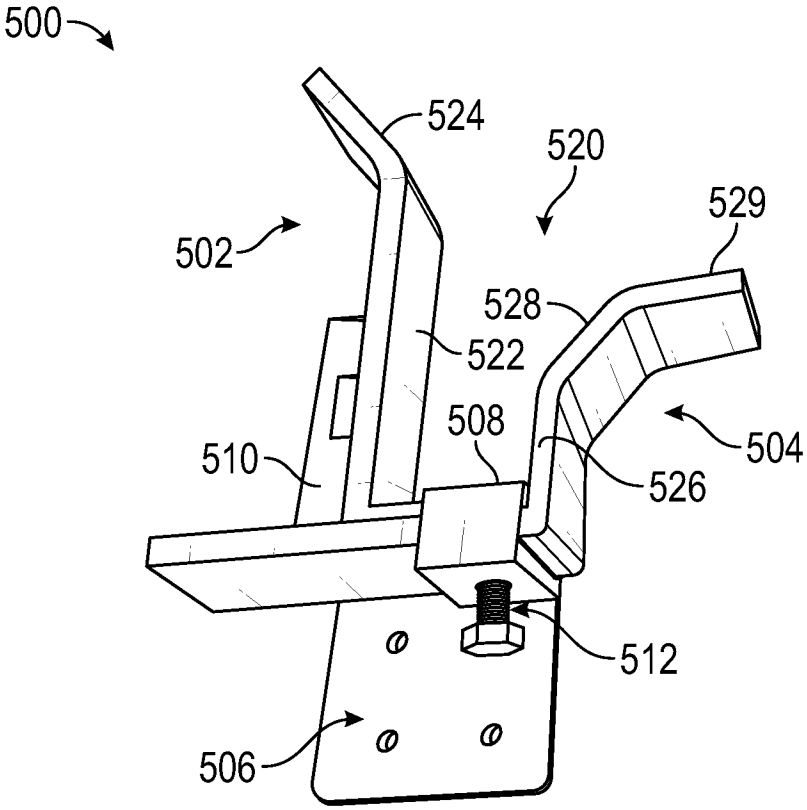

The first segment 502 can extend higher (e.g., vertically) than the second segment 504. That is, the top of the first segment 502 can be a greater vertical distance from the bottom alignment guide than the second segment 504. The taller of the two segments 502, 504 can be disposed on the outer side of the joist guide 500 and the shorter of the two segments 502, 504 can be disposed on the inner side of the joist guide 500. The joist guide 500 can include a reinforcement 510 along the outer side of the joist guide 500 (e.g., along the external-facing side of the first segment 502 as shown in FIG. 13). The taller segment, the first segment 502, can help direct the joist of the floor panel, and the reinforcement 510 can provide additional support (e.g., to prevent damage to the joist guide 500). The shorter segment, the second segment 504, can help position the joist of the floor panel while maintaining a low enough profile so as to reduce the risk of blocking, or otherwise interfering with, the joist.

The mounting flange 506 can be used to mount the joist guide 500 to a support structure 250. For example, fasteners, such as lags, bolts, and/or screws, can be inserted through apertures in the mounting flange 506 and into a lateral side of a top plate 200. The mounting flange 506 can extend below the upper surface 202 of the top plate 200.

The bottom alignment guide 508 can be configured to receive a joist of a floor panel. In some embodiments, the bottom alignment guide can include at least three points which define an upper plane against which to position the bottom surface of a joist. The joist guide 500 can be mounted on the support structure 250 such that the upper surface of the bottom alignment guide 508 is aligned with (e.g., positioned along the same horizontal plane as) the upper surface 202 of the top plate 200 of the wall. This can advantageously allow for a bottom surface of a joist to lay flat on the upper surface 202 of the top plate 200 of the wall and the upper surface of the bottom alignment guide 508 of the joist guide 500.

Loosening the fastener 512 can enable the second segment 504 to slide relative to the first segment 502. For example, loosening the fastener 512 can permit surface 522 to move toward or away from surface 526. Tightening the fastener 512 can fix the relative positions of the first segment 502 and the second segment 504.

Method of Using Rim Guide Assembly and/or Joist Guide to Seat a Floor Panel

The method of using one or more rim guide assembly 400 and one or more joist guide 500 to seat a floor panel can include any of the steps outlined below, in any order.

Figure 29:
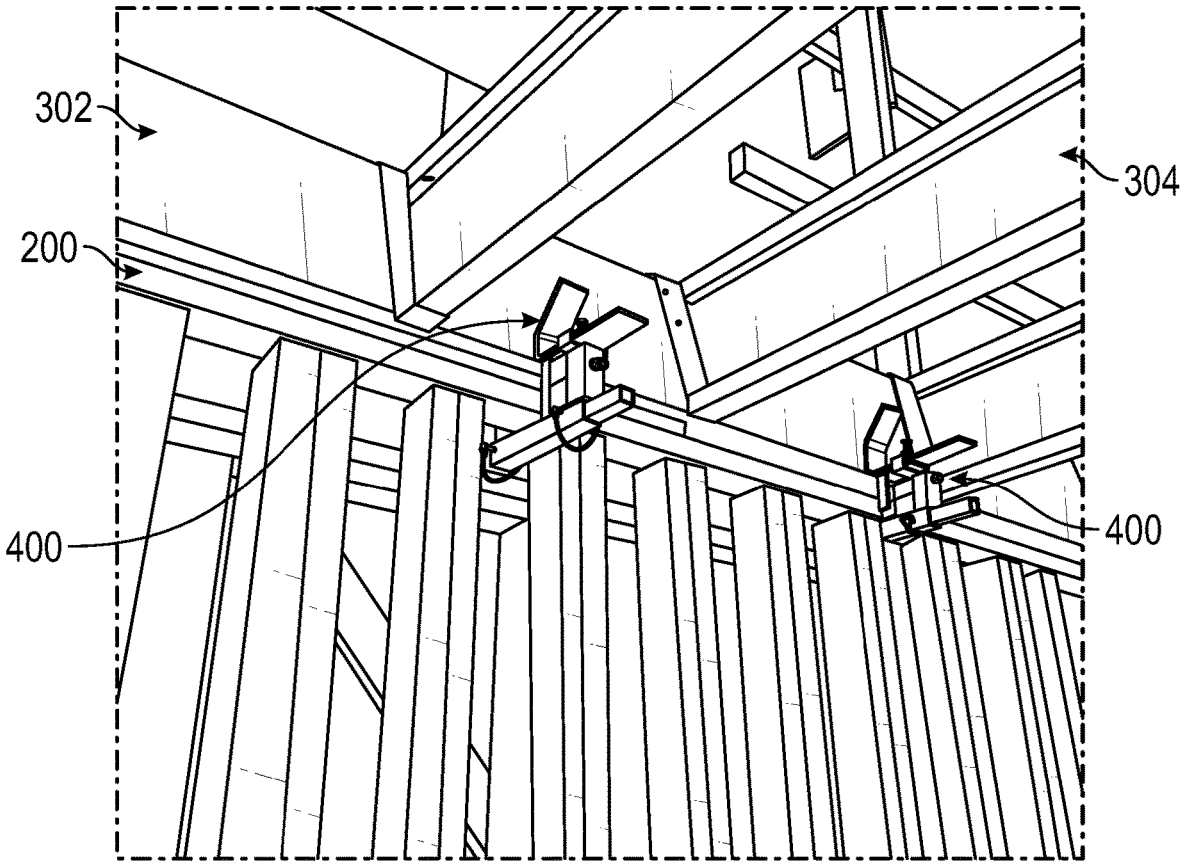
FIG. 29 illustrates two rim guides mounted on a top plate of a wall of a support structure and gripping a rim of a floor panel, the rim guides spaced apart on opposite sides of a joist of the floor panel.

The method can include determining a position for a first rim guide assembly 400. The method can include positioning and clamping a main body 402 of a first rim guide assembly 400 to a first top plate 200 of a support structure 250, with a first clamping surface 416 flush with an outer surface 204 of the top plate 200. The method can include making macro adjustments of the rim guide assembly 400 before and/or after clamping the rim guide assembly 400 to the first top plate 200. The method can include making fine adjustments of the first rim guide assembly 400 to securely clamp the first rim guide assembly 400 to the first top plate 200. The method can include coupling the mount body 404 to the main body 402 (FIG. 18). The method can include adjusting the spacing between the first guide surface 414 and the second guide surface 444 to correspond to the expected thickness of the cross-member 302 of the floor panel 300. The method can include determining a position for a second rim guide assembly 400. The method can include positioning and clamping the second rim guide assembly 400 to the first top plate 200 (FIGS. 2A, 29). The method can include making adjustments to the second rim guide assembly 400 as outlined above with respect to the first rim guide assembly 400. The method can include determining a position for a first joist guide 500. The method can include positioning and mounting a first joist guide 500 to a lateral surface of the first top plate 200 (FIG. 17). The method can include adjusting the distance between the first guide surface 522 and the second guide surface 526 of the first joist guide 500 to correspond to the expected thickness of the joist 304 of the floor panel (FIG. 15). The method can include determining a position for a second joist guide. The method can include positioning and mounting the second joist guide 500 to a lateral surface of a second top plate 200 (FIG. 25). The method can include adjusting the distance between the first guide surface 522 and the second guide surface 526 of the second joist guide 500 to correspond to the expected thickness of the joist 304.

The method can include lowering a first floor panel 300 over a support structure (FIG. 21) and dropping the first floor panel 300 into the desired position on the support structure 250 using the first and second rim guide assemblies 400 to guide the cross-member 302 of the floor panel and using the first and second joist guides 500 to guide the joist 304 of the floor panel (FIG. 2A, FIGS. 22-25). The joist 304 can desirably be an outermost joist along one side of the floor panel.

The method can include positioning the first floor panel 300 such that a portion of the cross-member 302 of the first floor panel 300 extends beyond the outermost joist 304 of the first floor panel. The method can include positioning a second floor panel 300 next to the first floor panel 300 such that the cross-member 302 of the second floor panel 300 abuts the cross-member 302 of the first floor panel. The method can include installing a floor strip in the gap formed between the outermost joists 302 of the first and second floor panels 300.

The method can include removing the first rim guide assembly 400, second rim guide assembly 400, first joist guide 500, and second joist guide 500 from the support structure.

A floor plan, such as the one shown in FIG. 2B, can be generated to map out the desired position (and/or relative positions) of one or more rim guide assembly 400, joist guide 500, and/or any other guide/bracket described herein (e.g., L-bracket 600, elongate bracket 700, ledger guide 800). FIGS. 1, 17-20, and 22-29 illustrate examples of rim guide assemblies 400 and joist guides 500 positioned on support structures 250. In some embodiments, as illustrated in FIG. 17, the desired position for a rim guide assembly 400 can be adjacent to (but spaced apart from) a joist guide 500, 500' along the length of a top plate 200. As illustrated in FIG. 18, the desired position for a rim guide assembly 400 can be a location that is spaced further from (e.g., more isolated from) other guides. As illustrated in FIG. 19, the desired position for a joist guide 500 can be adjacent to (but spaced apart from) a joist guide 500' along the length of a top plate 200. The desired position for a joist guide 500 can be a location that is spaced further from (e.g., more isolated from) other guides (FIGS. 2A, 25). As shown, more than one rim guide assembly 400 can be positioned along the length of the same top plate 200 (FIG. 29), more than one joist guide 500 can be positioned along the length of the same top plate 200 (FIG. 19), a rim guide assembly 400 and/or a joist guide 500 can be positioned along the length of the same top plate 200 (FIGS. 2A, 17). As illustrated in FIGS. 2A and 24-25, a rim guide assembly 400 and joist guide 500 can be positioned on different sides of a support structure 250 (such as on top plates 200 that are on opposite portions of a support structure 250 facing one another).

In some embodiments, as shown in FIG. 19, a first joist guide 500' facing in a first direction and a second joist guide 500 facing in a second direction opposite the first direction can be mounted adjacent, but spaced apart from, one another along the length of a top plate 200. In the illustrated embodiment, the first joist guide 500' is configured to capture a joist 304 of a first floor panel 300 and the second joist guide 500 is configured to capture a joist 304 of a second floor panel 300. When the first and second floor panels 300 are installed in their desired positions, a gap can exist between the outermost joists 304 of each floor panel 300 (e.g., the joists 304 captured by the joist guides 500', 500). A wood panel can be installed to fill said gap. The gap can advantageously provide tolerance to accommodate for errors that can occur during the installation of floor panels.

Figure 20:
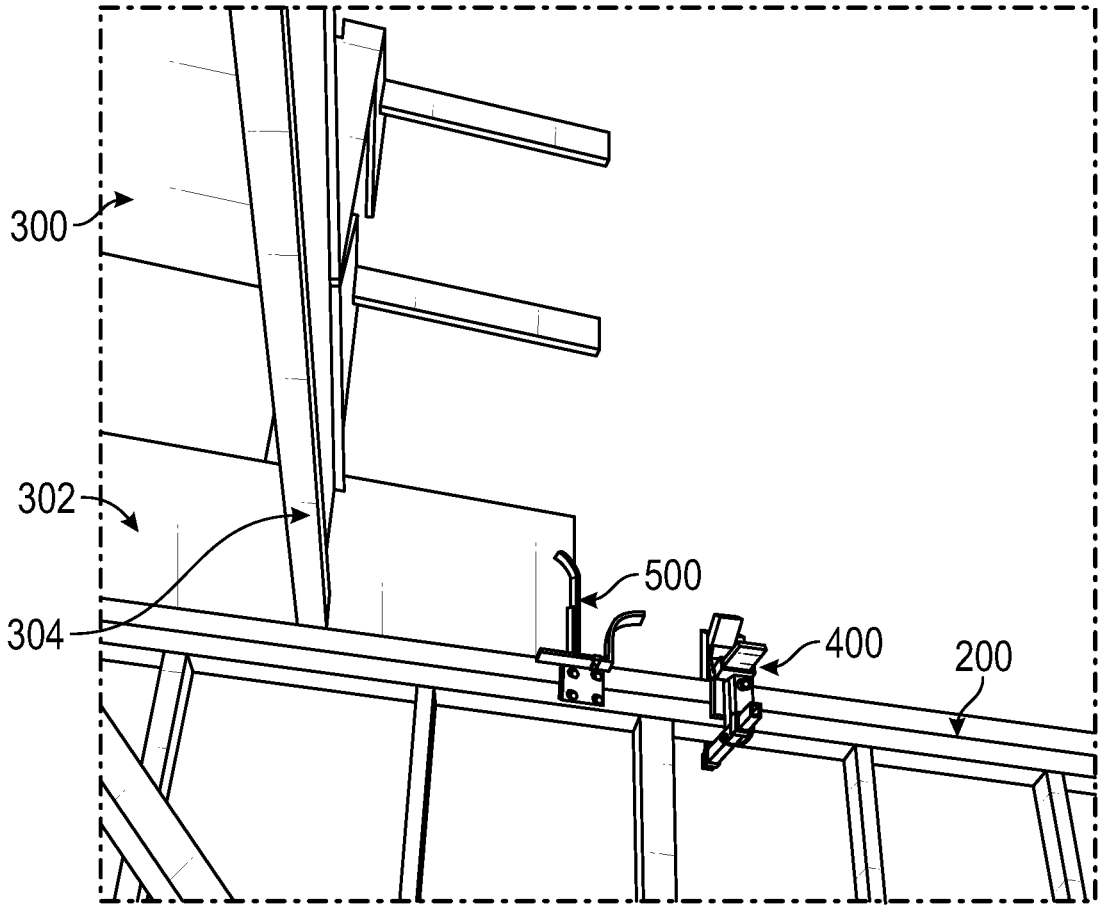
FIG. 20 illustrates a joist guide and a rim guide mounted on a top plate of a wall of a support structure and a rim of a floor panel extending laterally beyond the joists of the floor panel.

In some embodiments, as illustrated in FIG. 20, a cross-member 302 of a first floor panel 300 can extend laterally beyond the outermost joist 304 of said first floor panel. Although a second floor panel can be positioned next to the first floor panel 300 such that the cross-member 302 of the first floor panel comes close to, or abuts, a cross-member of the second floor panel, a gap can exist between the outermost joists 304 of each floor panel. A wood panel can be installed to fill said gap. The gap can advantageously provide tolerance to accommodate for errors that can occur during the installation of floor panels.

Figure 27:
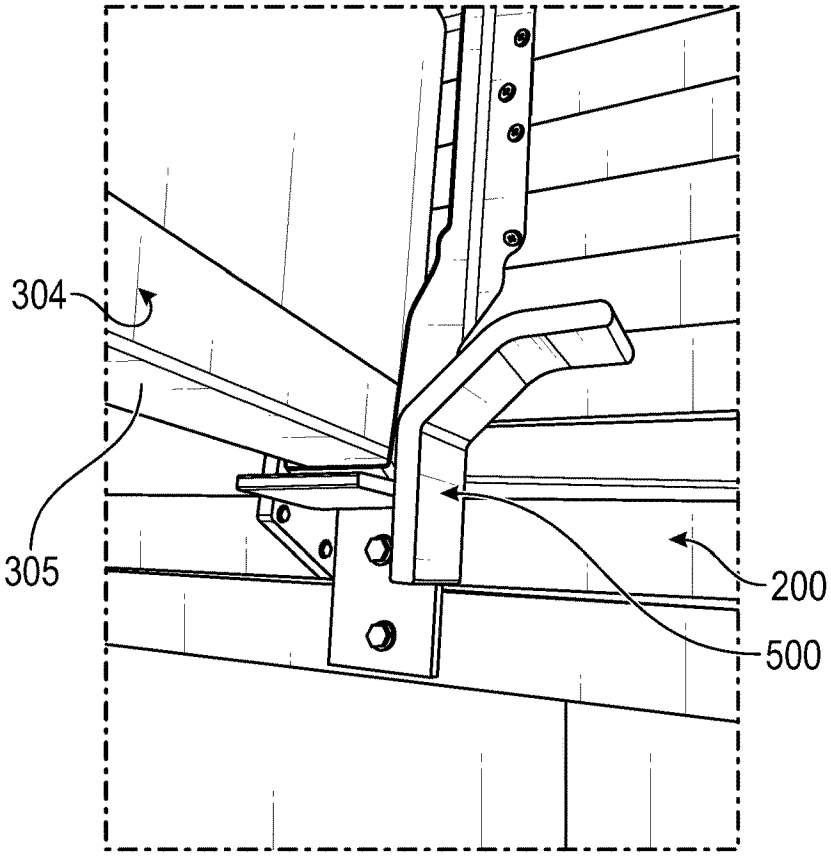
FIGS. 26-27 illustrate a joist guide gripping a joist of a floor panel.
Figure 26:
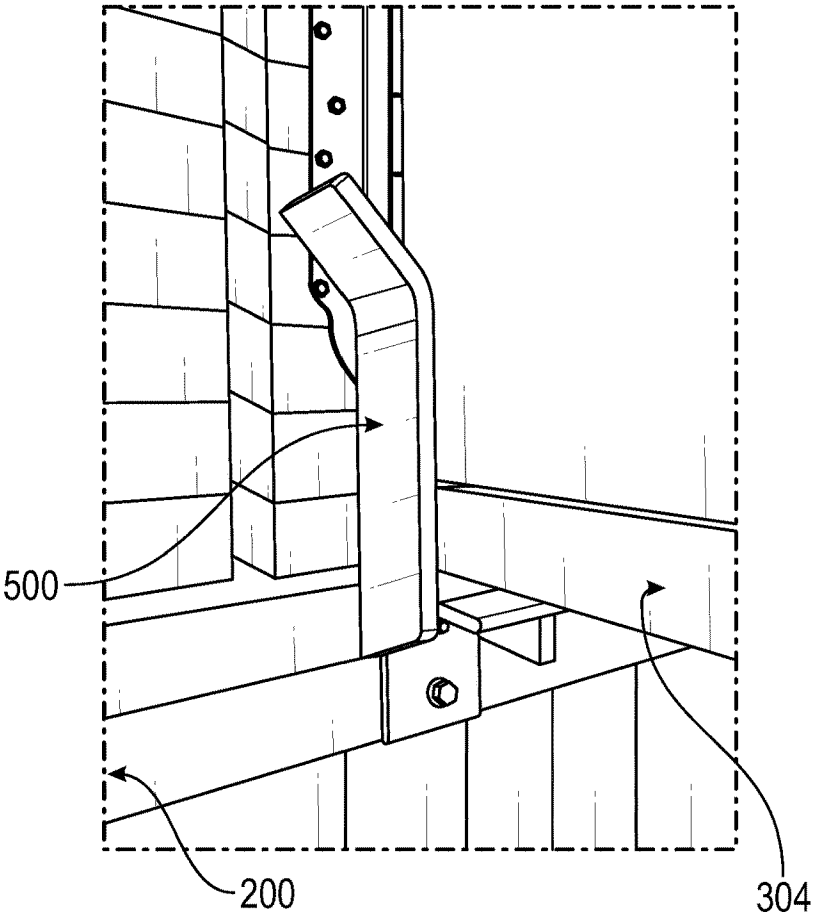
Figure 28:
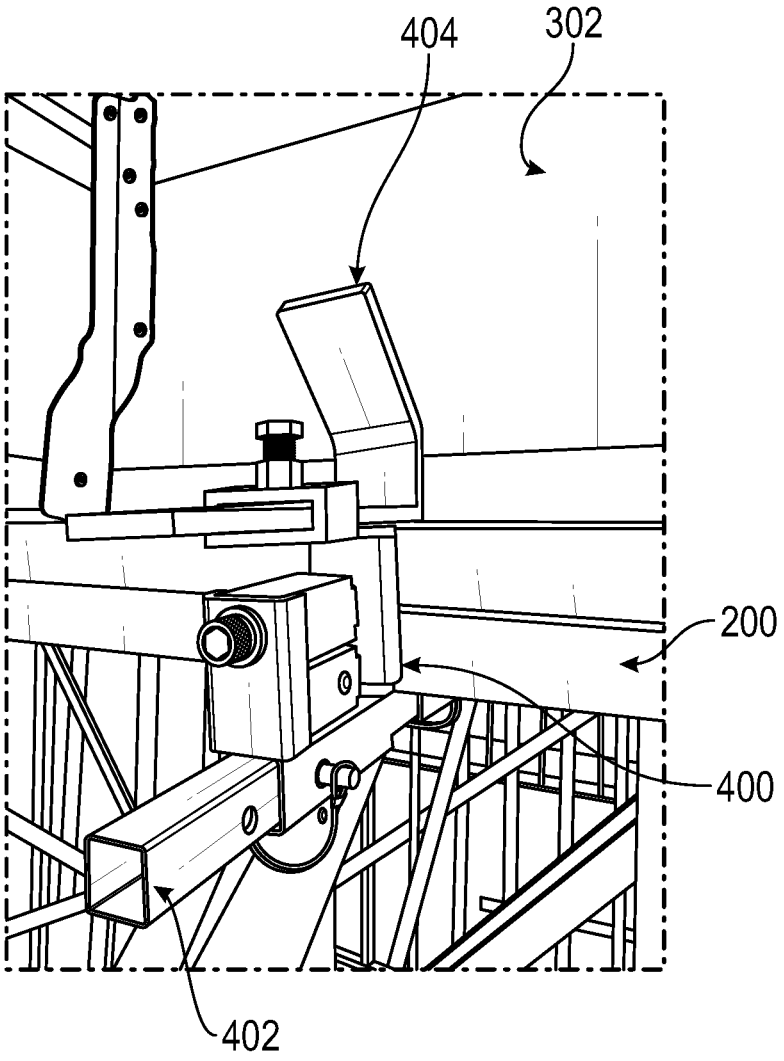
FIG. 28 illustrates a rim guide gripping a rim of a floor panel.

Rim guide assemblies 400 and joist guides 500 can be mounted adjacent to one another and/or on opposite sides of a frame structure from one another to provide points of contact to help guide the floor panel 300 into position. Desirably, the floor panel seating assembly 100 can provide more than one (e.g., two, three, four, etc.) point of contact for guiding the floor panel 300, such as two points of contact for one corner of the floor panel 300 and another point of contact on the side of the floor panel 300 opposite that corner. As shown in FIGS. 26-28, the rim guide assemblies 400 can be used to guide (e.g., catch, direct, etc.) the cross-member(s) 302 of a floor panel 300 and the joist guides 500 can be used to guide (e.g., catch, direct, etc.) the joist(s) 304 of the floor panel 300.

As previously described, the rim guide assembly 400 can be adjusted to accommodate different top plate 200 widths and floor panel cross-member 302 widths, and/or the joist guide 500 can be adjusted to accommodate different floor panel joist 304 widths. In some embodiments, the rim guide assembly 400 and/or joist guide 500 can be adjusted to accommodate the size of a given top plate 200 or floor panel 300 before being mounted to the support structure 250. In some embodiments, the rim guide assembly 400 and/or joist guide 500 can be adjusted to accommodate the size of a given top plate 200 or floor panel 300 after being mounted to the support structure 250. In some embodiments, some amount of adjustment of the guide(s) 400, 500 can occur before mounting the guide(s) to the top plate 200 and some amount of adjustment of the guide(s) can occur after mounting the guide(s) to the top plate 200.

As illustrated in FIG. 21, an assembled floor panel 300 can be provided. The floor panel 300 can include cross-member(s) 302 and joist(s) 304. The floor panel 300 can weigh 500-5,000 lbs, or 2,000-3,000 lbs, or 1,000-3,500 lbs. The floor panel 300 can weigh at least 500 lbs, or 2,000 lbs, or 3,500 lbs. The floor panel 300 can be lowered to a position above a support structure 250 using a crane 900. As shown in FIGS. 22-25, the floor panel 300 can be aligned with one or more rim guide assembly 400 and/or joist guide 500. Once aligned above the guide(s), the floor panel 300 can be lowered onto the guide(s) and dropped into the desired position. The guide(s) can help direct the floor panel 300 into the desired position, with the rim guide assembly 400 directing a cross-member 302 of the floor panel 300 and the joist guide 500 directing a joist 304 of the floor panel 300. The cross-member 302 can slide into the opening 460 in the rim guide assembly 400, the bottom surface of the cross-member 302 contacting the upper surface 202 of the top plate 200 and the outer surface of the cross-member 302 aligning with the outer surface 204 of the top plate 200. The joist 304 can slide into the opening 520 in the joist guide 500, the lower surface 305 of the joist 304 contacting the upper surface 202 of the top plate 200 and the upper surface of the bottom alignment guide 508. The support structure 250 can provide the majority of the support provided to the floor panel 300 once the floor panel 300 is seated on the top plate 200.

Figure 22:
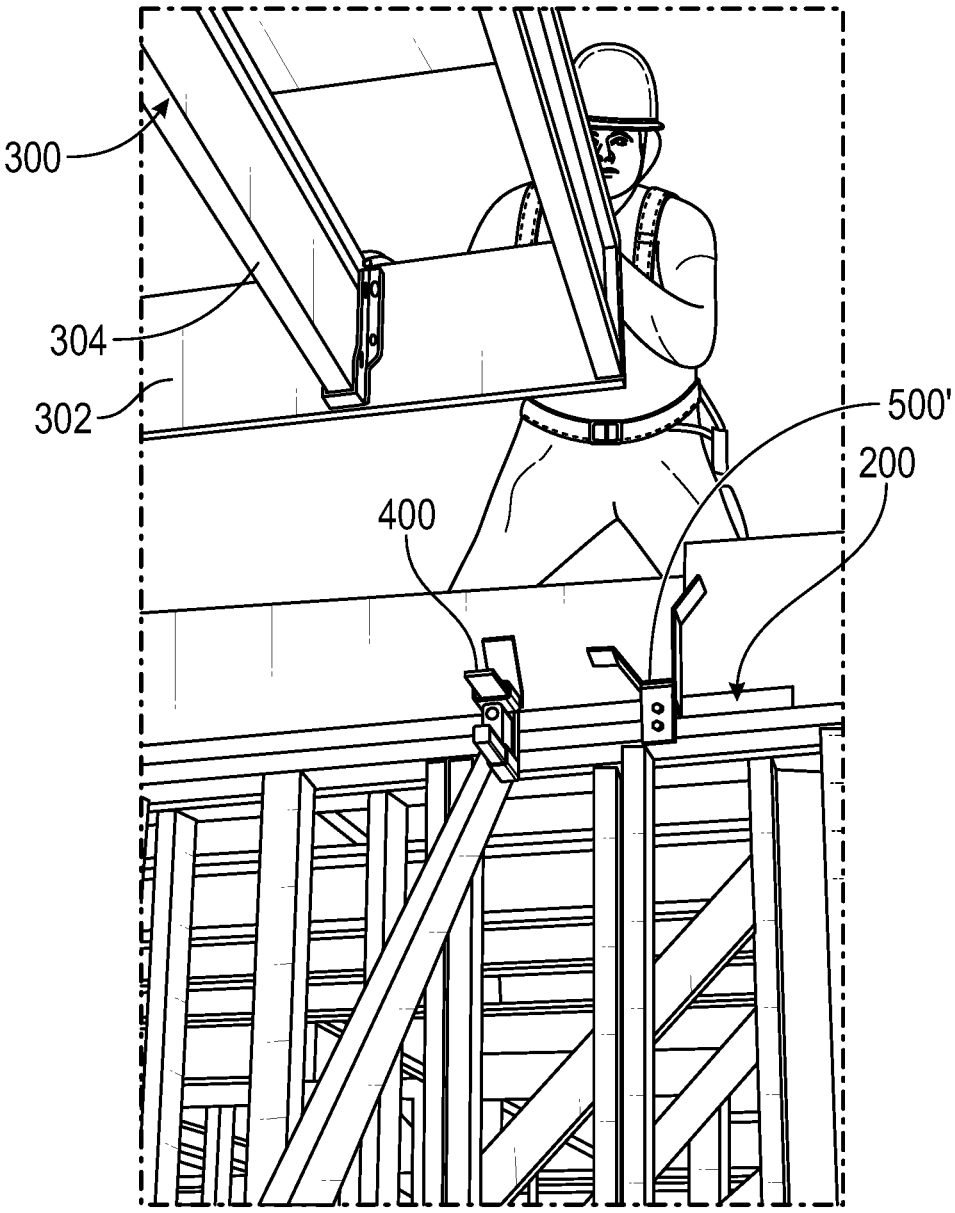
FIGS. 22-25 illustrate a method of seating a floor panel on a support structure, the floor panel being guided into position on one end by a rim guide and a joist guide and on an opposing end by a second joist guide.
Figure 23:
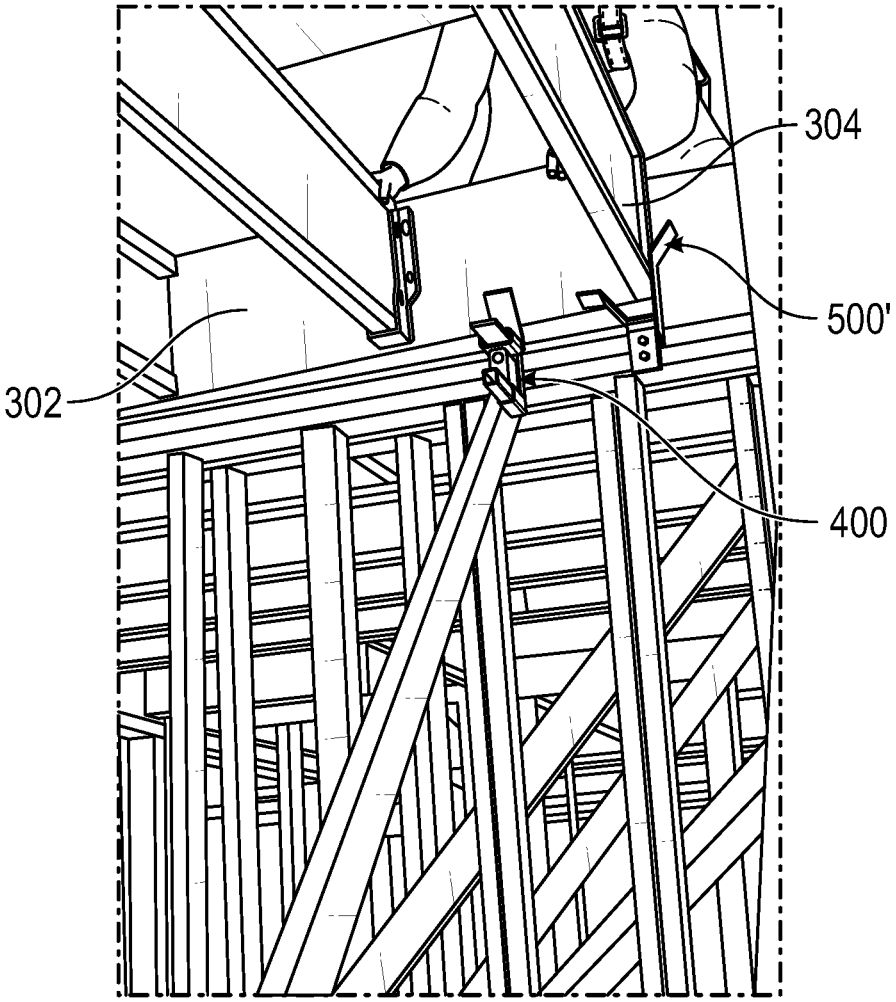
Figure 24:
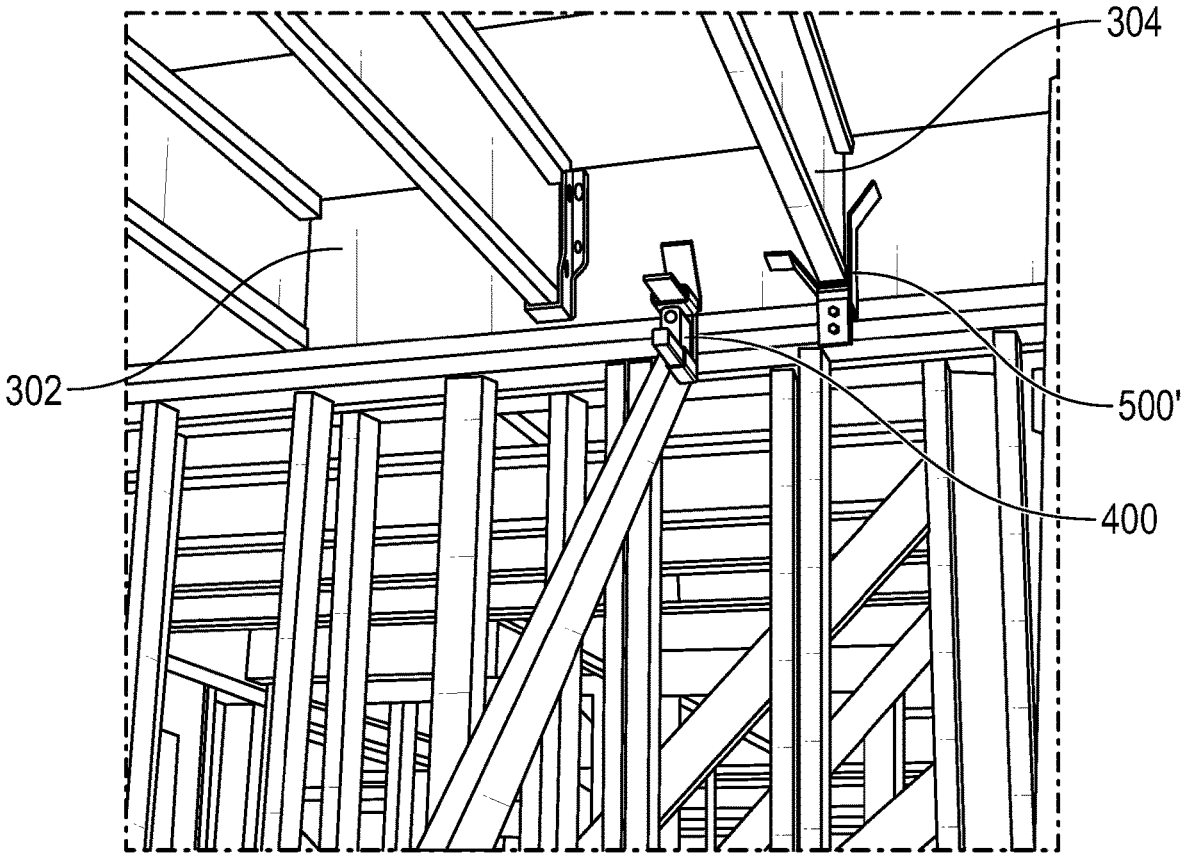

FIGS. 22-24 show an example of a floor panel being guided into position by brackets/guides that are mounted on the support structure 250. Optionally, as illustrated in FIG. 25, a bracket(s)/guide(s) may also be mounted on a second end of the support structure 250 (e.g., such that brackets can help guide the floor panel at opposing ends of the floor panel). Desirably, a combination of one or more rim guide assemblies 400 and one or more joist guides 500 can be used in conjunction to seat the floor panel 300. As shown in FIGS. 22-25, a rim guide assembly 400 and a first joist guide 500 can be mounted adjacent to one another along the length of a top plate 200, and a second joist guide 500 can be mounted to a top plate 200 on the opposite end of the support structure 250 (e.g., parallel to and facing the top plate 200 to which the rim guide assembly 400 and first joist guide 500 are mounted). As shown, the rim guide assembly 400 can catch a cross-member 302 of the floor panel, the first joist guide 500 can catch a joist 304 at a first end of the joist 304 (e.g., the end of the joist 304 closest to said cross-member 302), and the second joist guide 500 can catch the joist 304 at a second end of the joist 304 opposite the first end. This arrangement can advantageously increase the speed and accuracy with which the floor panel 300 is seated.

The rim guide assembly 400 and/or the joist guide 500 can be removable and reusable. For example, after a given floor panel 300 is seated, the rim guide assemblies 400 and joist guides 500 can be removed from the top plates 200 and mounted to different top plates 200 or support structure(s) 250 for use in positioning another floor panel 300.

L-Bracket

Figure 30:
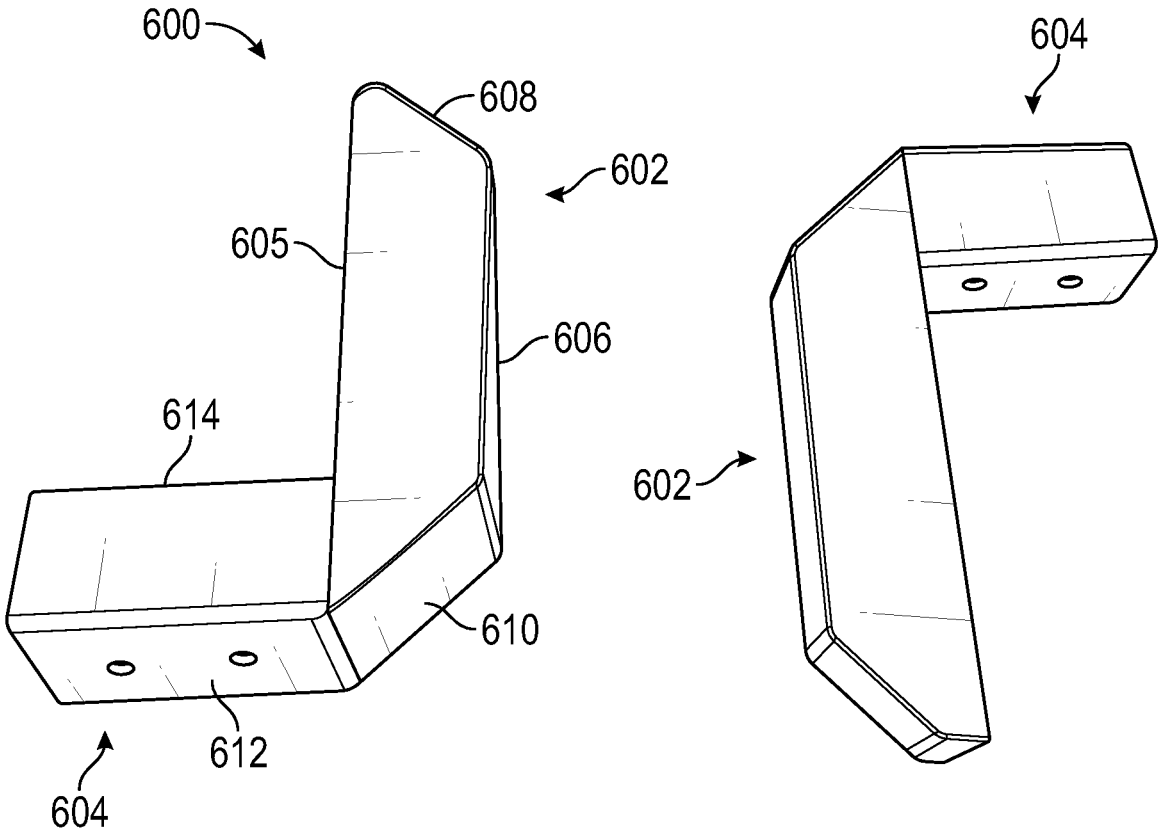
FIGS. 30-31 are different views of an embodiment of an L-bracket.

FIG. 30 illustrates an embodiment of an L-bracket 600. The L-bracket 600 can be used by itself or in combination with other guides discussed herein. The L-bracket 600 can desirably be used when there is a solid top plate and there is not space to attach a rim guide assembly 400 to the top plate 200. For example, the L-bracket 600 can be used on party walls. The L-bracket 600 can be generally L-shaped. The L-bracket 600 can include a first segment 602 and a second segment 604. The first segment 602 can be perpendicular to the second segment 604.

The first segment 602 can define a guide surface 606 and angled surfaces 608, 610. The angled surfaces 608, 610 can be disposed on either end of the first segment 602. The angled surfaces 608, 610 can be angled at 45 degrees relative the guide surface 606. The second segment 604 can define a first side 612 and a second side 614.

Figure 31:
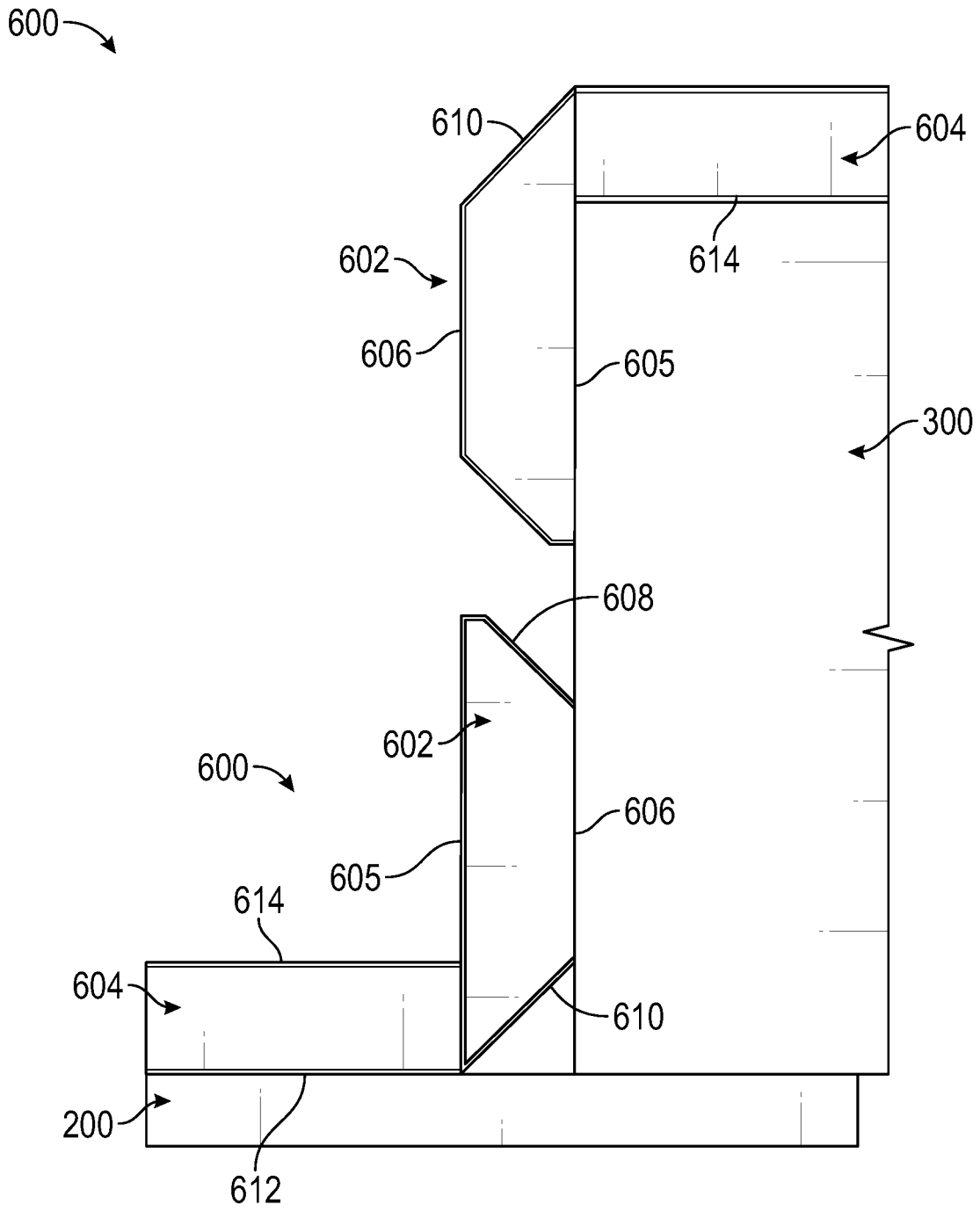
Figure 33:
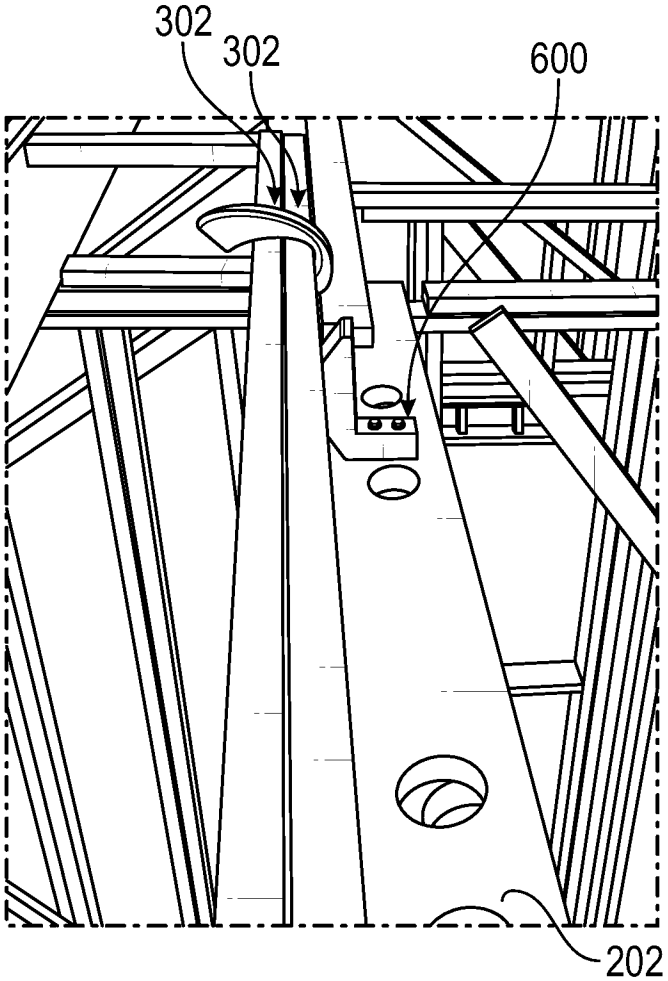
FIGS. 32-34B illustrate a method of installing the L-bracket of FIG. 30 on top of a top plate of a wall of a support structure, guiding a first floor panel into position, removing and reorienting the L-bracket, securing the L-bracket to the floor panel, and guiding a second floor panel into position.
Figure 32:
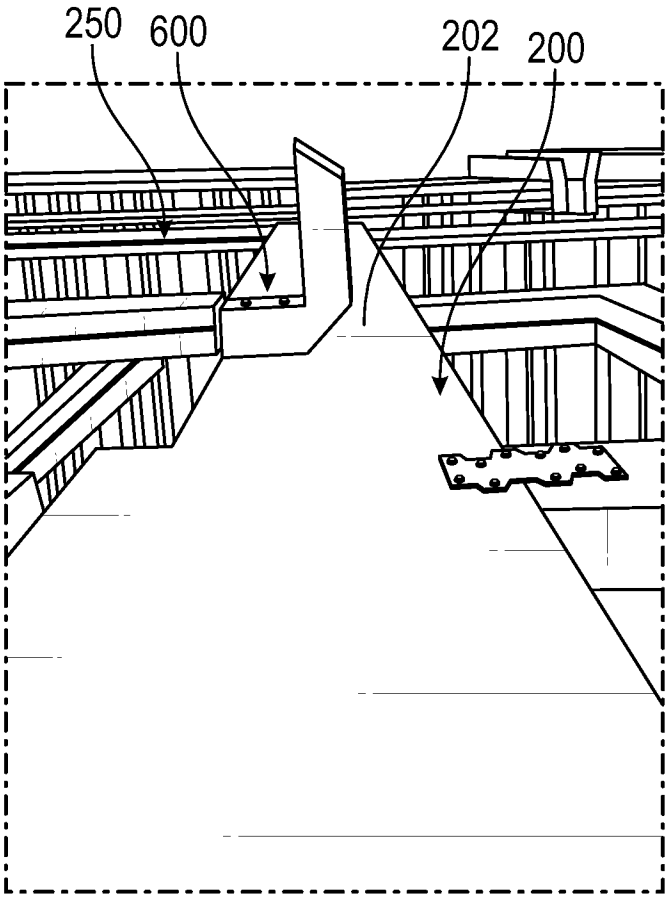
Figure 34A:
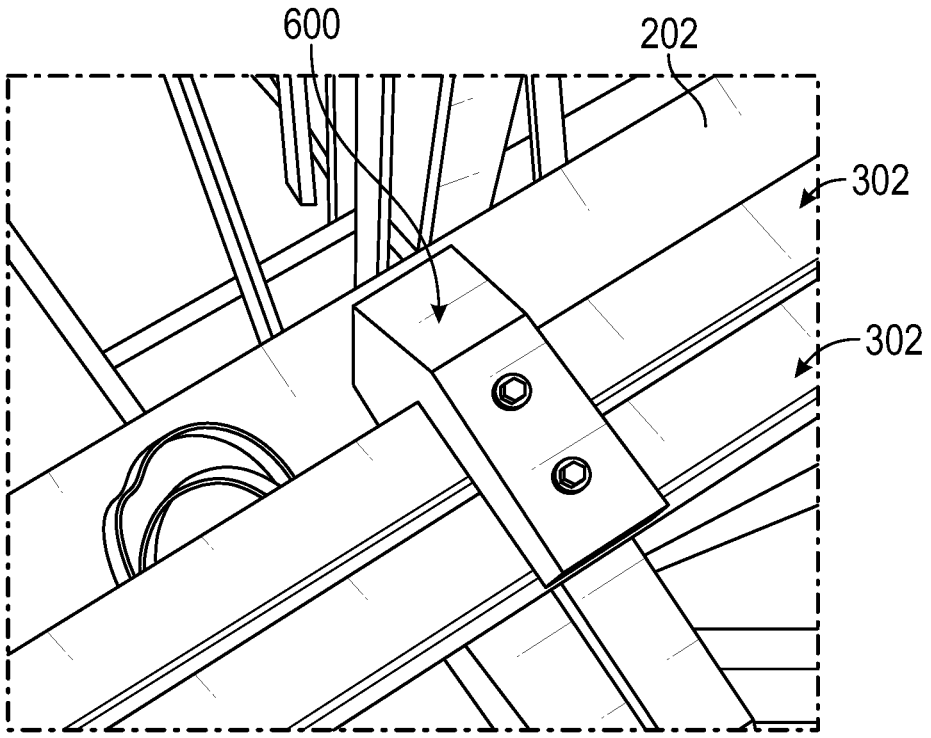
Figure 34B:
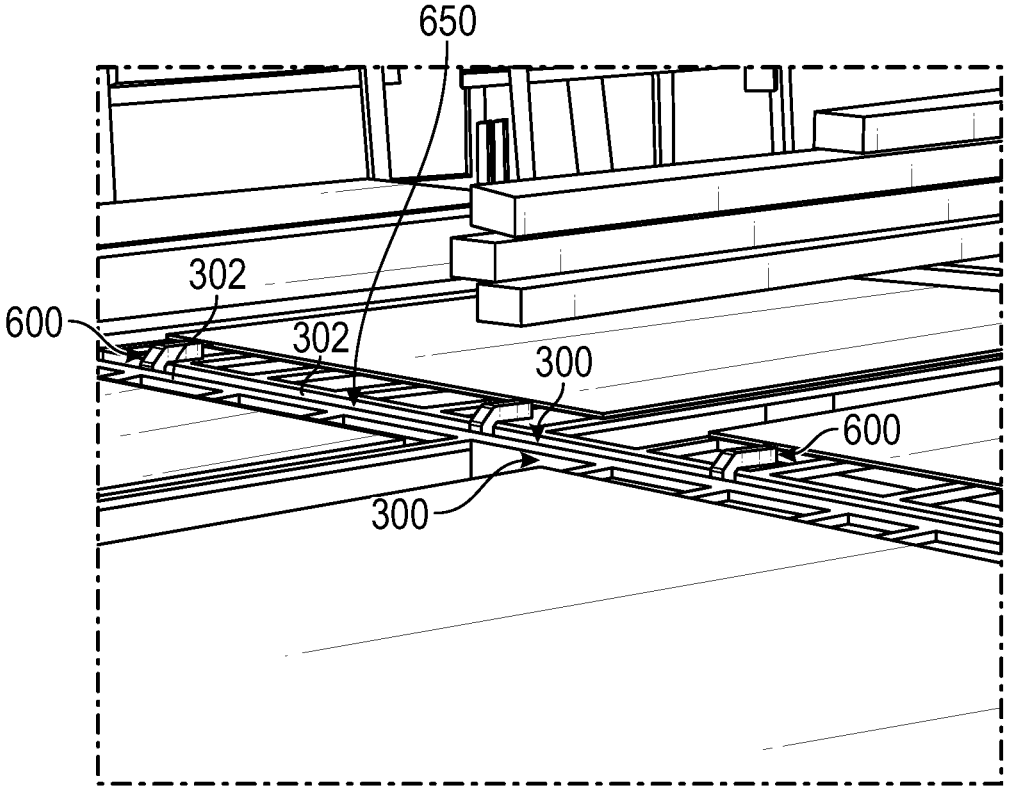

FIGS. 31-34B illustrate a method of using the L-bracket 600 to guide cross-members 302 of floor panels 300 into the desired positions on a support structure 250. As shown in FIG. 32, the L-bracket 600 can be mounted to (e.g., screwed onto) the upper surface 202 of the top plate 200 with the first side 612 of the second segment 604 in contact with the upper surface 202 of the top plate 200. A first floor panel 300 can be lowered into the desired position, using the angled surface 608 and/or guide surface 606 of the first segment 602 to guide the cross-member 302 of the first floor panel 300. As shown in FIGS. 31 and 34A, once the first floor panel 300 is positioned, the L-bracket 600 can be detached from the upper surface 202 of the top plate 200, reoriented (e.g., flipped), and secured to the top surface of the cross-member 302. The L-bracket 600 can be mounted to the cross-member 302, with the second side 614 of the second segment 604 in contact with the top surface of the cross-member 302 and the interior surface 605 of the first segment 602 in contact with an outer surface of the cross-member 302. A second floor panel 300 can be lowered into the desired position, using the angled surface 610 and/or guide surface 606 of the first segment 602 to guide the cross-member 302 of the second floor panel 300 (FIG. 34B). Once the floor panels 300 are positioned, the L-bracket 600 can be removed. As shown in FIG. 34B, the L-bracket 600 can preserve a gap 650 between first and second seated floor panels 300. The gap 650 can be at least 1", or 2", or 3". The gap 650 can be less than 5", or 4", or 3". The gap 650 formed between the first and second seated floor panels 300 can advantageously allow for appropriate sound attenuation for the building being constructed.

Elongate Bracket

Figure 35:
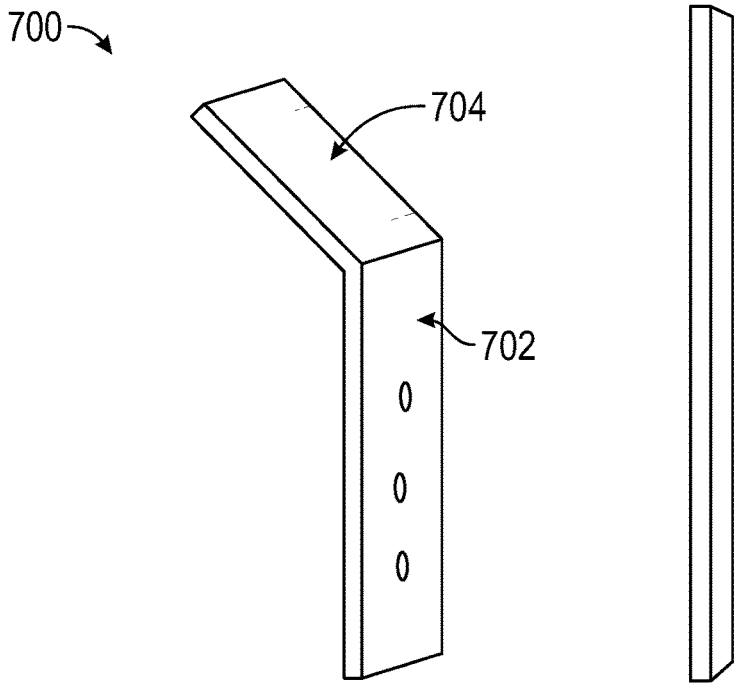
FIG. 35 illustrates an embodiment of an elongate bracket.

FIG. 35 illustrates an embodiment of an elongate bracket 700. The elongate bracket 700 can include a guide portion 702 and an angled portion 704. The angled portion 704 can be angled relative to the guide portion 702. The elongate bracket 700 can be used by itself or in combination with other guides discussed herein. For example, the elongate bracket 700 can be used in conjunction with a rim guide assembly 400 or a main body 402 of the rim guide assembly 400. The elongate bracket 700 and the main body 402 can be mounted along the length of the same top plate 200 and/or can be mounted on separate top plates 200 opposite one another. The elongate bracket 700 can desirably be used when there is a solid top plate and wall studs interfere with the use of certain other guide configurations. For example, the elongate bracket 700 can be used to position floor panels 300 near corridors and plumbing walls.

Figure 36:
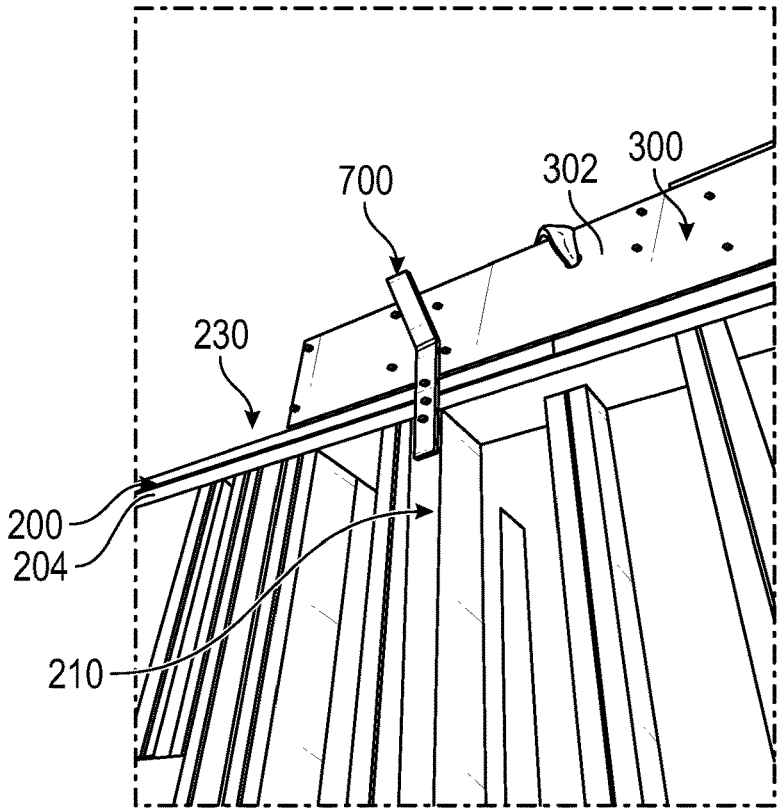
FIG. 36 illustrates the elongate bracket of FIG. 35 mounted on a wall of a support structure.
Figure 37:
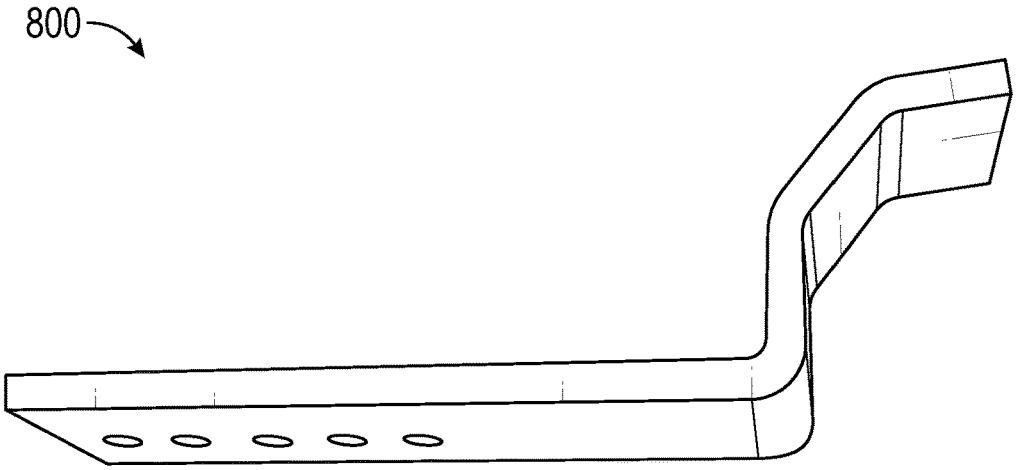
FIGS. 37-38 illustrate an embodiment of a ledger guide.

FIG. 36 illustrates the elongate bracket 700 mounted on a wall 230. A lower portion of the guide portion 702 can be mounted to an outer surface of the wall 230. For example, as shown in FIG. 36, the lower portion of the guide portion 702 can be mounted to an outer surface of a wall stud 210 and/or an outer surface of a top plate 200. The angled portion 704 and the upper portion of the guide portion 702 (e.g., the portion extending above the top plate 200 when the elongate bracket 700 is mounted to the wall 230) can guide a cross-member 302 of a floor panel 300 into position such that the outer surface of the cross-member 302 of the floor panel 300 aligns with the outer surface 204 of the top plate 200.

Ledger Guide

Figure 38:
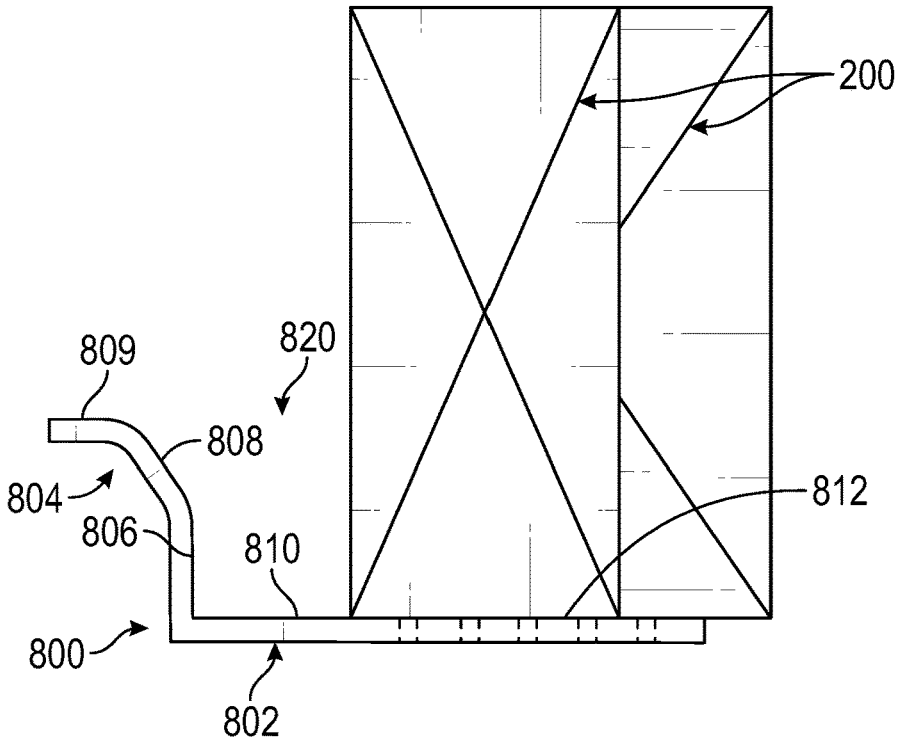

FIGS. 37-40 illustrate an embodiment of a ledger guide 800 that can be used to guide a ledger 306 of a floor panel 300 into a desired position abutting a beam 240. As illustrated in FIG. 38, the ledger guide 800 can include a horizontal segment 802 and a guide portion 804. The horizontal segment 802 can define an upwardly facing alignment surface 810 and an upwardly facing mounting surface 812. The guide portion 804 can define a guide surface 806 and angled surfaces 808, 809. The angled surfaces 808, 809 can be angled relative to the guide surface 806 and relative to one another.

Figure 39:
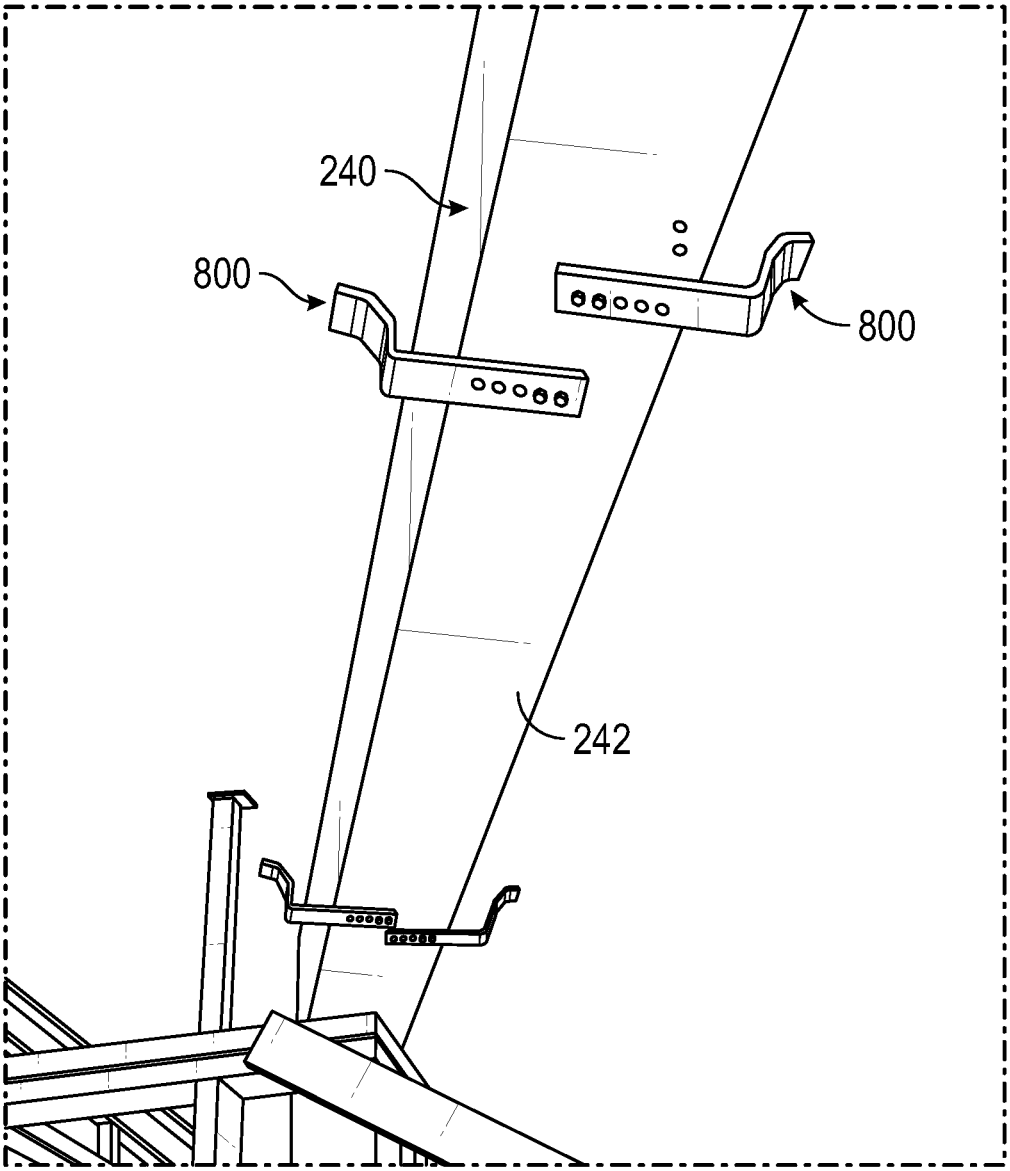
FIGS. 39-40 illustrate a method of mounting the ledger guide of FIG. 37 to the bottom surface of a beam of a support structure and lowering a ledger of a floor panel into the ledger guide.
Figure 40:
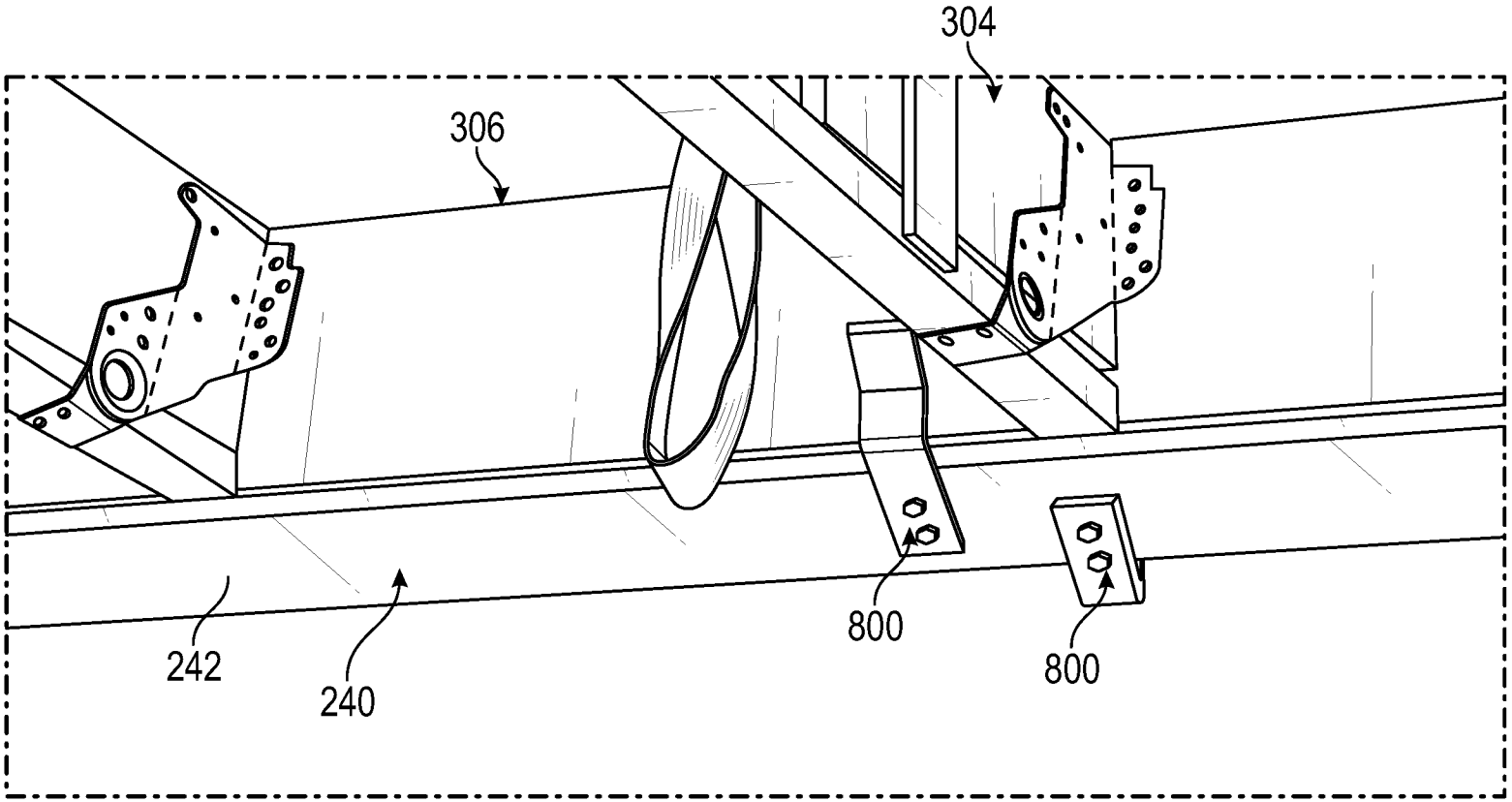

As shown in FIG. 39, one or more ledger guides 800 (or one or more pairs of ledger guides 800) can be coupled to the beam 240. Two or more ledger guides 800 can be coupled to the lower surface 242 of the same beam 240. The two or more ledger guides 800 can be spaced apart laterally along the length of the beam 240 and/or can be spaced apart by the width of the beam 240.

The ledger guide 800 can be configured to slide under and couple to a lower surface 242 of the beam 240. The ledger guide 800 can be secured to the beam 240 such that the upwardly facing mounting surface 812 abuts the lower surface 242 of the beam 240 and the upwardly facing alignment surface 810 extends outward from beneath the beam 240. The gap formed between the outer surface of the beam 240 and the guide portion 804 of the ledger guide 800 can define an opening 820 for receiving a ledger 306 of a floor panel 300. The ledger guide 800 can accommodate beam 240 of different sizes (such as beams having widths of at least 3.5", 4", or 5.5" and beams having widths less than 15", or 10", or 7"). The ledger guide 800 can extend at least 1", or 1.5", or 3" beneath the beam 240. The ledger guide 800 can extend less than 12", or 10", or 6" beneath the beam 240. The ledger guide 800 can extend beneath at least half of the width of the beam 240.

The ledger 306 of the floor panel 300 can be lowered into the opening 820. The angled surfaces 808, 809 and the guide surface 806 of the guide portion 804 can direct the ledger 306 into the desired position. The ledger guide 800 can hold the ledger 306 flush against the outer surface of the beam 240 so that the ledger 306 can be fastened to the beam 240.

Ledger Support

Figure 41:
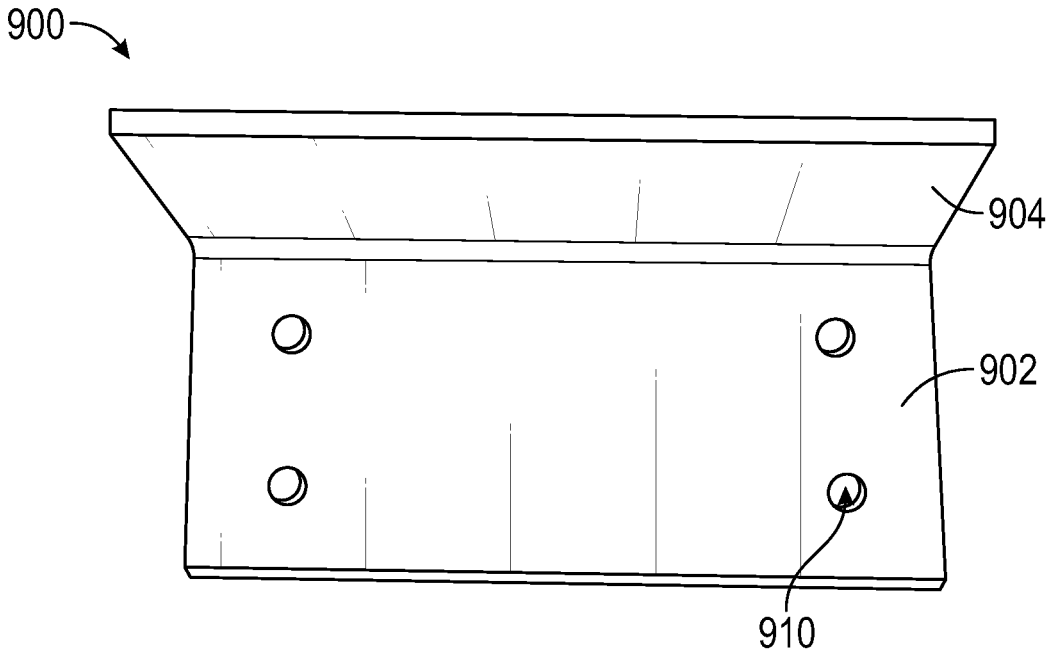
FIG. 41 illustrates different views of an embodiment of a ledger support.
Figure 41:
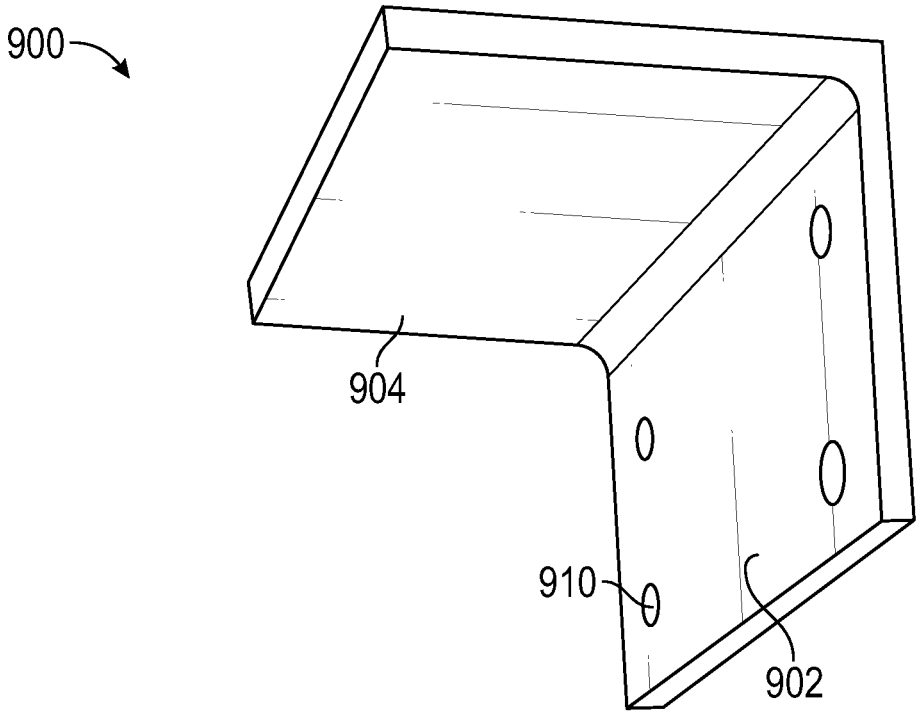
Figure 42:
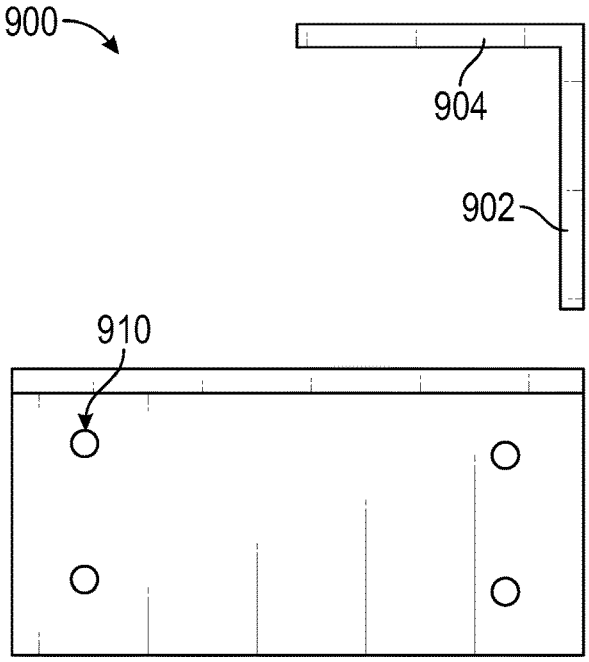
FIG. 42 illustrates schematic views of the ledger support of FIG. 41.

FIGS. 41-42 illustrate an embodiment of a ledger support 900. The ledger support 900 can include a first segment 902 and a second segment 904. The second segment 904 can be perpendicular to the first segment 902. The first segment 902 can define apertures 910. The apertures 910 can be configured to receive fasteners.

Figure 43:
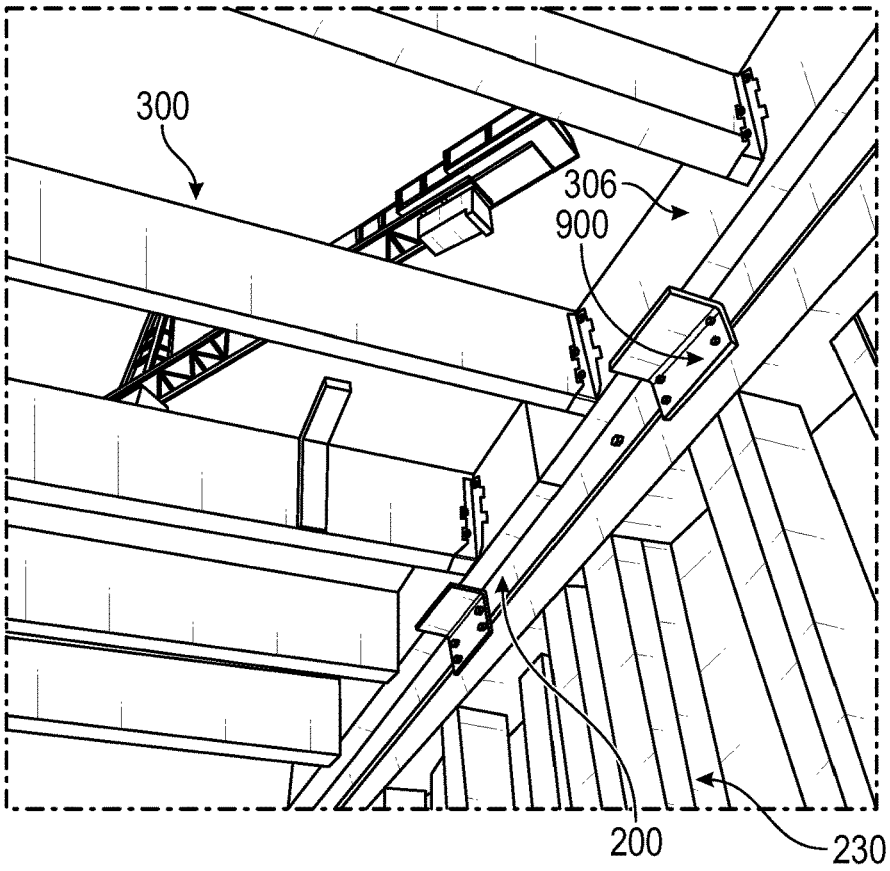
FIGS. 43-44 illustrate a method of mounting the ledger support of FIG. 41 to a wall of a support structure and supporting a ledger of a floor panel.
Figure 44:
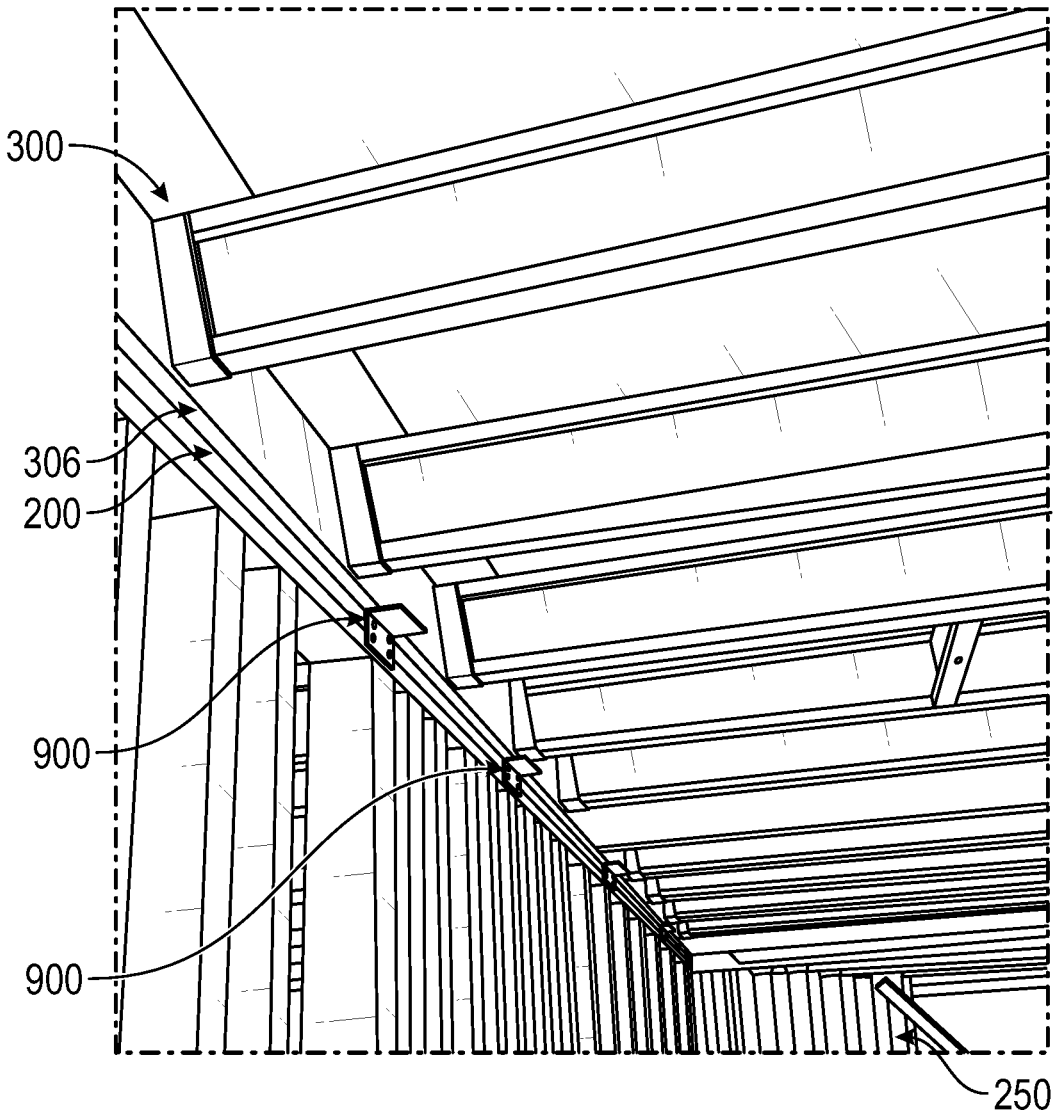

FIGS. 43-44 illustrate a method of mounting ledger supports 900 to a side surface of a top plate 200 of a wall 230. The first segment 902 can be mounted to the side surface of the top plate 200 by inserting fasteners through the apertures 910 in the first segment 902 and into the top plate 200. The second segment 904 can extend laterally away from the side surface of the top plate 200 to which the first segment 902 is mounted. A floor panel 300 can be lowered on top of the ledger supports 900 such that the ledger 306 of the floor panel rests on the upper surface of the second segment 904. The ledger support 900 can provide temporary support for the floor panel 300 before the floor panel 300 is permanently fixed to the support structure 250. The ledger support 900 can be removed once the floor panel 300 is fixed to the support structure 250.

From the foregoing description, it will be appreciated that inventive floor panel seating assemblies and methods of seating a floor panel are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A method of positioning at least one floor panel during construction of a building, the method comprising:

providing a first assembled floor panel including a plurality of joists extending between a first pair of sides and a pair of cross-members extending between a second pair of sides;

locating a desired first floor panel position on a support structure for a floor panel, said support structure including an upper support surface;

mounting a first bracket in a desired bracket position to the support structure, such that said first bracket defines a first portion and a second portion defining an opening for receiving one of the pair of cross-members of the first floor panel between said first portion and said second portion;

mounting a second bracket in a desired bracket position to the support structure, such that said second bracket defines a first segment and a second segment defining an opening for receiving one of the plurality of joists of the first floor panel between said first segment and said second segment;

positioning said first floor panel such that one of the pair of cross-members of the first floor panel is positioned between said first portion and said second portion of said first bracket and is supported by the upper support surface of the support structure, and such that one of the plurality of joists of the first floor panel is positioned between said first segment and said second segment of said second bracket; and positioning the first floor panel relative to an assembled second floor panel, said second assembled floor panel including a plurality of joists extending between a first pair of sides and a pair of cross-members extending between a second pair of sides, at least one of said pair of cross-members of the second floor panel extending beyond an outermost of the plurality of joists of the second floor panel, further comprising positioning said second bracket adjacent to at least one of said at least one end of said pair of cross-members of the second floor panel and positioning said first floor panel such that a portion of one of the plurality of joists of the first floor panel is positioned adjacent to said at least one end of said pair of cross-members extending beyond an outermost of the plurality of joists of the second floor panel.

2. The method of positioning a floor panel of claim 1, wherein said second bracket includes a bottom alignment guide defining a plane upon which one of said plurality of joists is supportable, further comprising positioning said first floor panel such that a lower surface of one of the plurality of joists of the first floor panel is supported by the bottom alignment guide.

3. The method of claim 1, further comprising mounting a third bracket in a desired bracket position to the support structure, such that said third bracket defines a first portion and a second portion defining an opening for receiving said one of the pair of cross-members of the first floor panel between said first portion and said second portion, and said mounting of said third bracket comprising mounting said third bracket in a position spaced from said first bracket.

4. The method of claim 3, further comprising mounting a fourth bracket in a desired bracket position to the support structure, such that said fourth bracket defines a first portion and a second portion defining an opening for receiving said one of the plurality of joists of the first floor panel between said first portion and said second portion, and said mounting of said fourth bracket comprising mounting said fourth bracket in a position spaced from said second bracket.

5. The method of claim 1, further comprising mounting a third bracket in a desired bracket position to the support structure, such that said third bracket defines a first portion and a second portion defining an opening for receiving said one of the plurality of joists of the first floor panel between said first portion and said second portion, and said mounting of said third bracket comprising mounting said third bracket in a position spaced from said second bracket.

6. The method of claim 1, wherein said second portion of said first bracket is movable with respect to the first portion of said first bracket, further comprising moving said second portion of the first bracket over a portion of the support structure.

7. The method of claim 6, further comprising using said first bracket to clamp onto a first side of the support structure and a second side of the support structure such that a section of the first support bracket extends below the support structure.

8. The method of claim 7, further comprising removing said first bracket and said second bracket from the support structure.

9. The method of claim 1, further comprising removing said first bracket and said second bracket from the support structure.

10. A method of positioning at least one floor panel during construction of a building, the method comprising:

providing a first assembled floor panel including a plurality of joists extending between a first pair of sides and a pair of cross-members extending between a second pair of sides;

locating a desired first floor panel position on a support structure for a floor panel, said support structure including an upper support surface;

mounting a first bracket in a desired bracket position to the support structure, such that said first bracket defines a first portion and a second portion defining an opening for receiving one of the pair of cross-members of the first floor panel between said first portion and said second portion;

mounting a second bracket in a desired bracket position to the support structure, such that said second bracket defines a first segment and a second segment defining an opening for receiving either (1) one of the plurality of joists of the first floor panel between said first segment and said second segment or (2) the one of the plurality of cross-members of the first floor panel between said first segment and said second segment;

positioning said first floor panel such that one of the pair of cross-members of the first floor panel is positioned between said first portion and said second portion of said first bracket and either (1) one of the plurality of joists of the first floor panel is positioned between said first segment and said second segment of the second bracket or (2) the one of the plurality of cross-members is positioned between said first segment and said second segment of said second bracket positioning the first floor panel relative to an assembled second floor panel, said second assembled floor panel including a plurality of joists extending between a first pair of sides and a pair of cross-members extending between a second pair of sides, further comprising positioning said second bracket adjacent to at least one of said pair of cross-members of the second floor panel and positioning said first floor panel such that a portion of one of the plurality of joists of the first floor panel is positioned adjacent to said at least one end of said pair of cross-members of the second floor panel; and after positioning the first floor panel relative to the assembled second floor panel, removing said first bracket and said second bracket from the support structure.

11. The method of positioning a floor panel of claim 10, wherein said second portion of said first bracket is movable with respect to the first portion of said first bracket, further comprising moving said second portion of the first bracket over a portion of the support structure.

12. The method of claim 11, further comprising using said first bracket to clamp onto a first side of the support structure and a second side of the support structure such that a section of the first support bracket extends below the support structure.

13. The method of claim 11, wherein said second bracket includes a bottom alignment guide defining a plane upon which one of said plurality of joists is supportable, further comprising positioning said first floor panel such that a lower surface of one of the plurality of joists of the first floor panel is supported by the bottom alignment guide.

14. The method of claim 10, further comprising using said first bracket to clamp onto a first side of the support structure and a second side of the support structure such that a section of the first support bracket extends below the support structure.

15. The method of claim 14, further comprising mounting a third bracket in a desired bracket position to the support structure, such that said third bracket defines a first portion and a second portion defining an opening for receiving said one of the pair of cross-members of the first floor panel between said first portion and said second portion, and said mounting of said third bracket comprising mounting said third bracket in a position spaced from said first bracket.

16. The method of claim 15, further comprising mounting a fourth bracket in a desired bracket position to the support structure, such that said fourth bracket defines a first portion and a second portion defining an opening for receiving said one of the plurality of joists of the first floor panel between said first portion and said second portion, and said mounting of said fourth bracket comprising mounting said fourth bracket in a position spaced from said second bracket.

17. The method of claim 10, further comprising mounting a third bracket in a desired bracket position to the support structure, such that said third bracket defines a first portion and a second portion defining an opening for receiving said one of the plurality of joists of the first floor panel between said first portion and said second portion, and said mounting of said third bracket comprising mounting said third bracket in a position spaced from said second bracket.

* * * * *